US011347249B2

(12) United States Patent
Shreepathi Bhat et al.

(10) Patent No.: US 11,347,249 B2
(45) Date of Patent: May 31, 2022

(54) CURRENT LIMIT THROUGH REFERENCE MODULATION IN LINEAR REGULATORS

(71) Applicant: Texas Instruments Incorporated, Dallas, TX (US)

(72) Inventors: Avinash Shreepathi Bhat, Tucson, AZ (US); Vadim Valerievich Ivanov, Dallas, TX (US)

(73) Assignee: Texas Instruments Incorporated, Dallas, TX (US)

( * ) Notice: Subject to any disclaimer, the term of this patent is extended or adjusted under 35 U.S.C. 154(b) by 17 days.

(21) Appl. No.: 16/934,334

(22) Filed: Jul. 21, 2020

(65) Prior Publication Data

US 2021/0080986 A1 Mar. 18, 2021

Related U.S. Application Data

(60) Provisional application No. 62/900,228, filed on Sep. 13, 2019.

(51) Int. Cl.
*G05F 1/569* (2006.01)
*G05F 1/575* (2006.01)

(52) U.S. Cl.
CPC ..... *G05F 1/569* (2013.01); *G05F 1/575* (2013.01)

(58) Field of Classification Search
CPC ..... G05F 1/569–575; G05F 1/468
See application file for complete search history.

(56) References Cited

U.S. PATENT DOCUMENTS 6,807,040 B2 * 10/2004 Ivanov ..... H03K 17/0822 361/93.1
7,777,455 B1 * 8/2010 Martin ..... H02M 3/158 320/160
2002/0118002 A1 * 8/2002 Luo ..... G05F 1/575 323/316
2009/0206811 A1 * 8/2009 Easwaran ..... G05F 1/561 323/282

(Continued)

OTHER PUBLICATIONS

Chester Simpson; "Linear and Switching Voltage Regulator Fundamentals" Texas Instruments; 2011; Dallas, Texas; Literature No. SNVA558.

(Continued)

*Primary Examiner* — Sisay G Tiku
(74) *Attorney, Agent, or Firm* — Mark A. Valetti; Charles A. Brill; Frank D. Cimino

(57) ABSTRACT

A linear regulator system is described. The linear regulator system includes a linear regulator core circuit including a pass element adapted to provide an output voltage, and a voltage error amplifier circuit coupled to the pass element and adapted to regulate the output voltage to form a regulated output voltage, based on an output reference voltage. The linear regulator core circuit further includes a current limit circuit comprising a current limit switch element coupled to the voltage error amplifier circuit and adapted to selectively modulate the output reference voltage of the voltage error amplifier circuit to form a current limited reference voltage, based on a current limit control signal received at a current limit control terminal associated therewith, in order to limit a load current through the pass element from exceeding a predefined maximum allowable load current limit.

25 Claims, 10 Drawing Sheets

(56) References Cited

U.S. PATENT DOCUMENTS

| | | | | |
|---|---|---|---|---|
| 2012/0098513 | A1* | 4/2012 | Terada | G05F 1/5735 323/284 |
| 2012/0187930 | A1* | 7/2012 | Williams | G05F 1/5735 323/273 |
| 2021/0080985 | A1* | 3/2021 | Shreepathi Bhat | G05F 1/565 |
| 2021/0234457 | A1* | 7/2021 | Silva | H02M 1/0025 |

OTHER PUBLICATIONS

Michael Day; "Understanding Low Drop Out (LDO) Regulators"; Texas Instruments Portable Power Design Seminar; 2006; Topic 9; Literature No. SLUP239A.

Sajjad Hajdar; "Current Limiter Offers Circuit Protection with Low Voltage Drop"; Electronic Design; Apr. 18, 2016; https://www.electronicdesign.com/power-management/article/21801456/current-limiter-offers-circuit-protection-with-low-voltage-drop.

Wikipedia; "Voltage Regulator" Last Edited: Jun. 16, 2020; https://en.wikipedia.org/wiki/Voltage_regulator#:~:text=A%20voltage%20regulator%20is%20a,electromechanical%20mechanism%2C%20or%20electronic%20components.

Jameco Electronics; "Electronics Fundamentals: Voltage Regulator"; https://www.jameco.com/Jameco/workshop/learning-center/voltage-regulator.html.

Brendan Whelan et al.; "Finally, High Voltage Current Sensing Made Easy"; Linear Technology; vol. XV, No. 2; May 2005.

Digikey; "How to Select and Apply Smart Current Sensing and Monitoring Technologies (Instead of Fuses)"; Digi-Key North American Editors; Oct. 6, 2016 https://www.digikey.com/en/articles/how-to-select-smart-current-sensing-monitoring-technologies.

Analog Devices "Understanding How a Voltage Regulator Works"; 2009 Analog Devices, Inc. https://www.analog.com/media/en/technical-documentation/tech-articles/Understanding-How-a-Voltage-Regulator-Norks.pdf.

* cited by examiner

CURRENT LIMIT THROUGH REFERENCE MODULATION IN LINEAR REGULATORS

REFERENCE TO RELATED APPLICATIONS

This application claims the benefit of provisional Application No. 62/900,228, filed Sep. 13, 2019, entitled "LINEAR REGULATOR WITH CURRENT LIMIT THROUGH REFERENCE MODULATION", contents of which are herein incorporated by reference in their entirety.

TECHNICAL FIELD

The present disclosure relates to linear regulators, and in particular, to systems and methods to limit load current in linear regulators through reference modulation.

BACKGROUND

Electronic circuits are designed to operate using a supply voltage, which is usually assumed to be constant. Examples of such systems include microcontrollers, frequency synthesizers, RF mixers etc. A linear regulator provides this constant DC output voltage and contains circuitry that continuously holds the output voltage at a value regardless of changes in load current or supply voltage. Specifically, the linear regulator provides a regulated output voltage for varying supply voltages and load currents, as long as the load currents and the supply voltages are within a specified operating range for the linear regulator.

SUMMARY

Figure 1A:
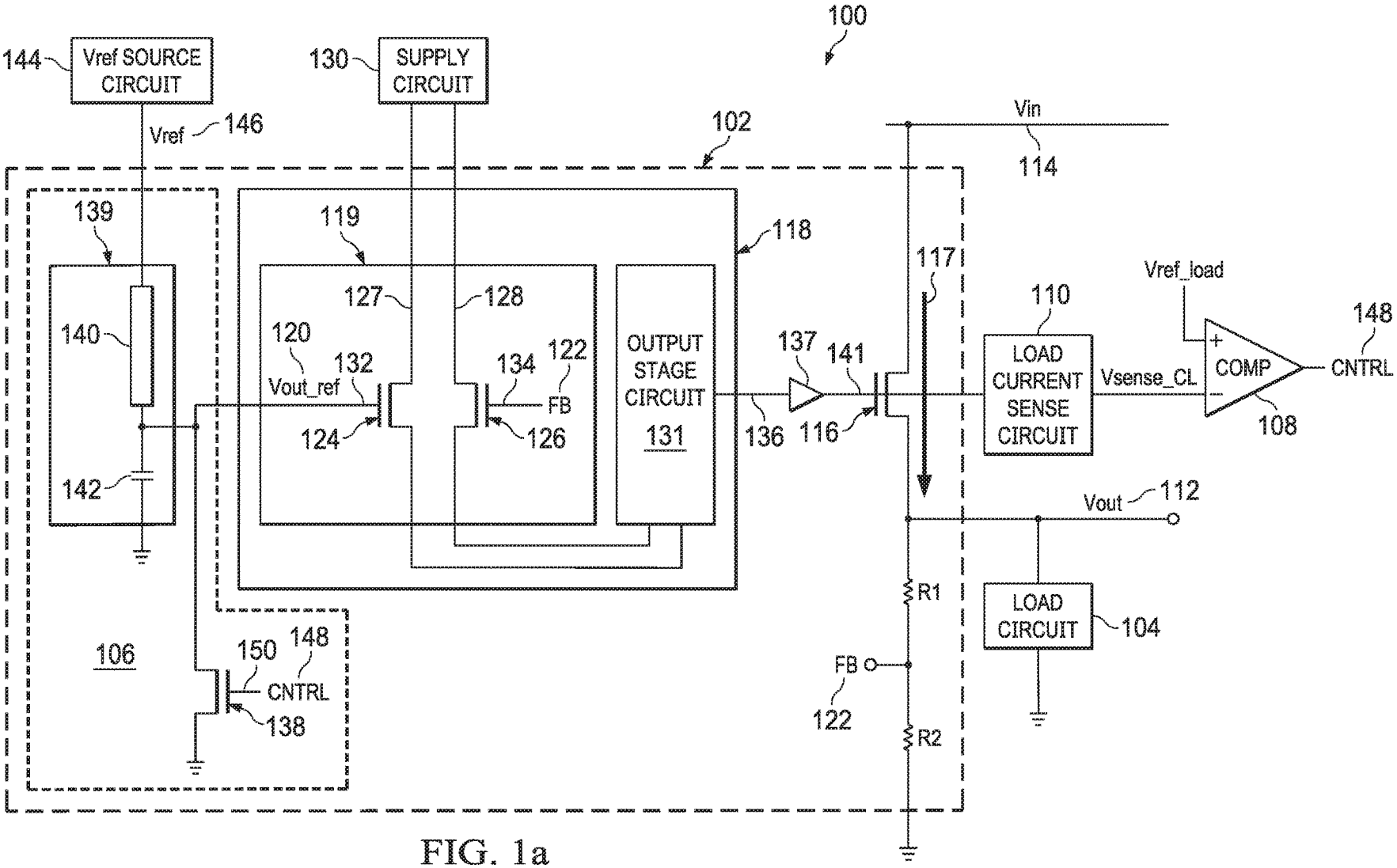
FIG. 1*a* illustrates a simplified block diagram of a linear regulator system, according to one aspect of the description.

In one aspect of the description, a linear regulator system comprises a linear regulator core circuit comprising a pass element adapted to provide an output voltage, and a voltage error amplifier circuit coupled to the pass element and adapted to regulate the output voltage to form a regulated output voltage, based on an output reference voltage. The linear regulator core circuit further comprises a current limit circuit comprising a current limit switch element coupled to the voltage error amplifier circuit and adapted to selectively modulate the output reference voltage of the voltage error amplifier circuit in a current limit mode to form a current limited reference voltage in order to limit a load current through the pass element from exceeding a predetermined threshold (e.g., a predefined maximum allowable load current limit).

In one aspect of the description, the voltage error amplifier circuit comprises an input stage circuit that comprises a feedback switch element adapted to receive a feedback voltage, derived from the output voltage, at a feedback control terminal associated therewith. The input stage circuit also comprises a reference switch element adapted to receive the output reference voltage at a reference control terminal associated therewith. The voltage error amplifier circuit further comprises a current limit circuit comprising a current limit switch element coupled in series to one of the reference switch element and the feedback switch element. In some aspects, a resistance of the current limit switch element is selectively modulated to a modulated ON resistance, based on a current limit control signal. In some aspects, the current limit control signal is derived from the current through the pass element. In some aspects, the modulated ON resistance comprises a resistance that is greater than a resistance of the current limit switch element in a fully ON state.

In one aspect of the description, the voltage error amplifier circuit further comprises a current limit circuit comprising a current limit switch element coupled to the reference control terminal of the reference switch element and adapted to be selectively turned ON with a specific ON resistance, based on a current limit control signal. In some aspects, the current limit control signal is derived from an information of a load current through the pass element.

DETAILED DESCRIPTION

The present description is described with reference to the attached figures. The figures may not be drawn to scale and they are provided merely to illustrate the description. Several aspects of the description are described below with reference to example applications for illustration. Numerous specific details, relationships, and methods are set forth to provide an understanding of the description. The present description is not limited by the illustrated ordering of acts or events, as some acts may occur in different orders and/or concurrently with other acts or events. Furthermore, not all illustrated acts or events are required to implement a methodology in accordance with the present description.

As indicated above, linear regulators provide a regulated output voltage for varying supply voltages and load currents, as long as the load currents and the supply voltages are within a specified operating range for the linear regulator. The linear regulators may be referred to as linear voltage regulators or voltage regulators, in other aspects. Typically, linear regulators include a pass element comprising a semiconductor switch element configured to provide an output voltage Vout to a load circuit associated therewith. Preferably, the output voltage Vout will remain at a regulated voltage, but under certain conditions Vout may not remain at a regulated voltage. In some aspects, a resistance of the pass element is controlled, in order to regulate the output voltage Vout of the linear regulator to form a regulated output voltage. Specifically, the linear regulators include a voltage feedback loop comprising a voltage error amplifier circuit that compares the output voltage Vout to an output reference voltage, in order to regulate the output voltage Vout to form the regulated output voltage.

Under some operating conditions, such as when the output load impedance decreases, as the output voltage is being held constant (i.e., being regulated), the output current will increase. To protect the linear regulator circuitry, such circuitry will enter a current limit mode of operation to prevent the output current from exceeding a predetermined threshold value. Typically in the prior art, during the current limit operation mode, the output voltage Vout of the linear regulator is varied from the regulated output voltage by the current limit circuit, in order to limit the load current from exceeding the predetermined threshold value (e.g., a maximum allowable load current limit which is, for example, defined during the fabrication of the device or by an end-users selection of external components that are connected to the device). Specifically, the output voltage Vout of the linear regulator is changed from the regulated output voltage to a current limited output voltage by the current limit circuit, when the load current is limited so as not to exceed the predefined maximum allowable load current limit. In conventional implementations of linear regulators, the current limit circuits are adapted to vary the output voltage Vout from the regulated output voltage to the current limited output voltage, based on controlling a control terminal (e.g., a gate terminal) of the pass element, or based on controlling a buffer circuit that is driving the pass element. Disadvantageously, in these conventional implementations of linear regulators, the voltage error amplifier circuit, which is upstream of the pass element, loses regulation during the current limit operation mode. In other words, during the current limit mode the output voltage Vout of the linear regulator is no longer regulated by the voltage error amplifier circuit based on the output reference voltage, thereby rendering the voltage error amplifier circuit nonfunctional during the current limit mode of operation. A voltage error amplifier circuit is said to be in regulation, when the voltage error amplifier circuit is configured to regulate the output voltage of the linear regulator based on the output reference voltage at the input of the voltage error amplifier circuit. Keeping the voltage error amplifier circuit nonfunctional during the current limit operation mode results in skewed nodes within the voltage error amplifier circuit during the current limit operation mode. Skewed nodes refer to nodes within the voltage error amplifier circuit whose voltages gets drifted with respect to the voltage values while the voltage error amplifier circuit is in regulation. While skewed nodes within the voltage error amplifier circuit have no effect on the output voltage during the current limit operation mode when the voltage error amplifier circuit is not regulating the output voltage Vout, such skewed nodes cause problems when the linear regulator exits the current limit mode of operation. More particularly, once the linear regulator exits the current limit operation mode and the voltage error amplifier circuit once again begins to regulate the output voltage Vout to the regulated output voltage, a large output voltage overshoot may occur before the output voltage Vout settles to the desired regulated output voltage. This condition is undesirable. The present disclosure eliminates, or at least reduces substantially, the large output voltage overshoot of conventional linear regulators by maintaining the regulating function of the voltage error amplifier circuit during the current limit mode, thus preventing the skewed nodes condition therein. Consequently, upon exiting the current limit mode of operation, the large voltage overshoot condition due to the skewed nodes condition is avoided.

A linear regulator of some example embodiments includes a current limit circuit that, in current limit mode, is adapted to limit the load current through the pass element from exceeding the predefined maximum allowable load current limit, while maintaining the voltage error amplifier circuit in regulation. In some example embodiments, the regulated output voltage of the linear regulator is varied to a current limited output voltage, in order to limit the load current through the pass element from exceeding the predefined maximum allowable load current limit. Specifically, during the current limit operation mode, the voltage error amplifier circuit of the example embodiments is configured to regulate the output voltage Vout of the linear regulator to the current limited output voltage based on a current limited reference voltage, in order to limit the load current from exceeding the predefined maximum allowable load current limit. In order to achieve this feature, therefore, some example embodiments include a current limit circuit coupled to the voltage error amplifier circuit and adapted to modulate the output reference voltage of the voltage error amplifier circuit to form the current limited reference voltage during the current limit operation mode. In this way, the voltage error amplifier circuit remains functional during the current limit mode, thus avoiding the skewed nodes condition and a large voltage overshoot upon an exit of the current limit mode.

FIG. 1*a* illustrates a simplified block diagram of a linear regulator system 100, according to one aspect of the disclosure. In some aspects, the linear regulator system 100 provides a regulated output voltage to load circuits 104. The linear regulator system 100 comprises a linear regulator core circuit 102 configured to provide an output voltage Vout 112 to load circuit 104 based on a supply voltage Vin 114. The linear regulator core circuit 102 includes a pass element 116 configured to provide the output voltage Vout 112 based on the input voltage Vin 114. In some aspects, the pass element 116 comprises a power semiconductor switch element like a metal oxide semiconductor field effect transistor (MOSFET), bipolar junction transistor (BJT) etc. Alternately, in other embodiments, the pass element 116 may comprise a combination of one or more power semiconductor switch elements. The linear regulator core circuit 102 further includes a voltage error amplifier circuit 118 coupled to the pass element 116 and adapted to regulate the output voltage Vout 112 to form a regulated output voltage $V_{REG}$, which will be described in greater detail in the following paragraphs. In some aspects, the voltage error amplifier circuit 118 is coupled to a control terminal of the pass element 116. In some aspects, the control terminal corresponds to a gate of a MOSFET or a base of a BJT. During regular operation, where current 117 remains less than a predefined maximum allowable load current, the voltage error amplifier circuit 118 is adapted to regulate the output voltage Vout 112 by altering the voltage at the gate of pass transistor 116 so that Vout remains at $V_{REG}$. The predefined maximum allowable load current limit is either hardwired into system 100, programmed into system 100 during final testing of system 100 or programmed after final test by an end-user (such as by connecting certain external circuit elements to system 100) and is the maximum current that should be allowed to flow through the pass element 116.

The voltage error amplifier circuit 118 is adapted to regulate the output voltage Vout 112 to the regulated output voltage $V_{REG}$, based on negative feedback, for example by comparing a feedback voltage FB 122 to an output reference voltage Vout_ref 120. The output reference voltage Vout_ref 120 can be defined by an end-user and feedback voltage FB 122 is based on a voltage divider circuit formed by R1, R2 and Vout 112. In some embodiments, the output reference voltage Vout_ref 120 may be provided to an input pin of the voltage error amplifier circuit 118. In some aspects, the value of the output reference voltage Vout_ref 120 may be defined by one or more external components attached to the input pin of the voltage error amplifier circuit 118. In particular, the voltage error amplifier circuit 118 generates a voltage error signal 136 based on the difference between the FB 122 and the Vout_ref 120, in order to regulate the output voltage Vout 112 to the regulated output voltage $V_{REG}$. The voltage error signal 136 is provided to a control terminal of the pass element 116 so as to alter the electrical characteristics of pass element 116. In some aspects, the voltage error signal 136 modulates a resistance of the pass element 116 so that FB 122 and Vout_ref 120 at the input terminals of the voltage error amplifier circuit 118 are substantially equal, thereby regulating the Vout 112 to form the regulated output voltage $V_{REG}$. The value of the Vout_ref 120 is chosen in a way that, when FB 122 and Vout_ref 120 are equal, Vout 112 is regulated to form the regulated output voltage $V_{REG}$.

The voltage error amplifier circuit 118 includes an input stage circuit 119 comprising a first circuit leg 127 and a second circuit leg 128, both of which are coupled to a supply circuit 130. In some aspects, the first circuit leg 127 and the second circuit leg 128 are equivalent to a first circuit path and a second circuit path, respectively. The supply circuit 130 may comprise a voltage source (such as a positive supply source (e.g., Vin) or a negative supply source (e.g., ground)) and/or a current source. The first circuit leg 127 includes a reference switch element 124 and the second circuit leg 128 includes a feedback switch element 126. In some aspects, the reference switch element 124 and the feedback switch element 126 comprise three-terminal power semiconductor switch elements like MOSFETs, BJTs etc. In some aspects, the reference switch element 124 and the feedback switch element 126 are symmetrically arranged with respect to one another. In some aspects, the reference switch element 124 and the feedback switch element 126 comprise the same type of power semiconductor switch element. However, in other aspects, the reference switch element 124 and the feedback switch element 126 may comprise different types of power semiconductor switch elements.

Figure 1B:
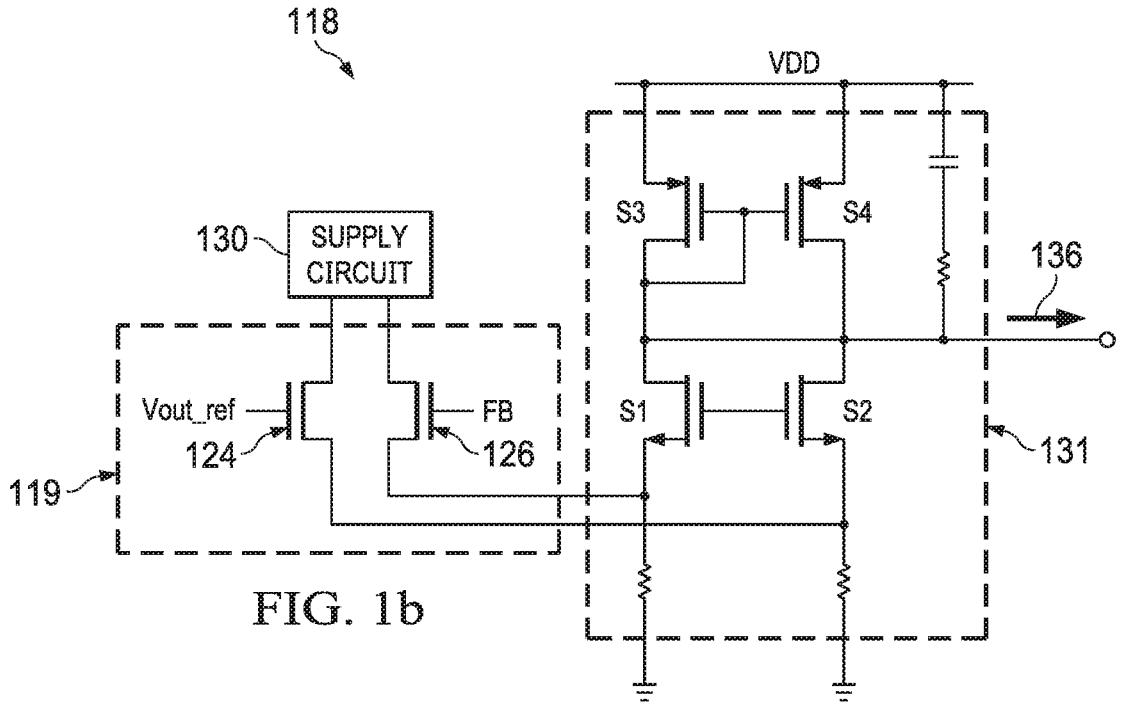
FIG. 1*b* illustrates one possible implementation of an output stage circuit of a voltage error amplifier circuit, according to one embodiment of the disclosure.

The reference switch element 124 is adapted to receive the output reference voltage Vout_ref 120 at a reference control terminal 132 associated therewith. In some aspects, the reference control terminal 132 corresponds to a gate terminal of a MOSFET or a base terminal of a BJT. The feedback switch element 126 is adapted to receive the FB voltage 122 at a feedback control terminal 134. In some aspects, the feedback control terminal 134 corresponds to a gate terminal of a MOSFET or a base terminal of a BJT. The voltage error amplifier circuit 118 further includes an output stage circuit 131 coupled to the input stage circuit 119 and adapted to generate the voltage error signal 136 to be provided to the pass element 116. In some aspects, the output stage circuit 131 includes resistors or a combination of resistors and power semiconductor switch elements configured to generate the voltage error signal 136 based on the difference between the output reference voltage Vout_ref 120 and the FB voltage 122. The output stage circuit 131 may be implemented differently in different embodiments. FIG. 1*b* illustrates one possible implementation of the output stage circuit 131. Specifically, the output stage circuit 131 comprises an NMOS S1, a source terminal of which is coupled to the feedback switch element 126. Further, the output stage circuit 131 comprises an NMOS S2, a source terminal of which is coupled to the reference switch element 124. The gate terminals of the NMOS S1 and the NMOS S2 are coupled to one another. In addition, the output stage circuit 131 comprises a current mirror arrangement comprising a PMOS S3 and a PMOS S4. In some aspects, the output stage circuit 131 is configured to provide the voltage error signal 136, based on a difference between the output reference voltage Vout_ref 120 and the FB voltage 122 at an output terminal associated therewith. However, other implementations of the output stage circuit 131 are also contemplated to be within the scope of this disclosure. In some aspects, the linear regulator core circuit 102 further includes a buffer/gate driver circuit 137 coupled between the voltage error amplifier circuit 118 and the pass element 116 and adapted to generate a gate driver signal 141 based on the voltage error signal 136. Alternately, the buffer/gate driver circuit 137 may not be present. In such aspects, the voltage error signal 136 may be directly provided to the control terminal of the pass element 116.

As indicated above, in some aspects, the voltage error amplifier circuit 118 is adapted to regulate the output voltage Vout 112 to form the regulated output voltage $V_{REG}$ during a regular mode of operation of the linear regulator core circuit 102 when the current 117 through the pass element 116 is less than the predefined maximum allowable load current limit. In certain circumstances in order to maintain the regulated output voltage $V_{REG}$, the current 117 may increase to the predefined maximum allowable load current limit. For example, when the resistance of load circuit 104 is less than a predefined load resistance limit, the current 117 may exceed the predefined maximum allowable load current limit if the regulated output voltage $V_{REG}$ is to be maintained. A load current larger than the predefined maximum allowable load current limit may cause damage to the pass element 116. In some example embodiments, linear regulator system 100 will enter into a current limit operation mode when the current 117 through pass transistor 116 approaches (or tries to exceed) the predefined maximum allowable load current limit.

In order to limit the current 117 from exceeding the predefined maximum allowable load current limit, the linear regulator core circuit 102 further includes a current limit circuit 106 coupled to the voltage error amplifier circuit 118. Specifically, the current limit circuit 106 modulates the output reference voltage Vout_ref 120 of the voltage error amplifier circuit 118 to form a current limited reference voltage $V_{ref_CL}$ during the current limit operation mode, in order to limit the current 117 from exceeding the predefined maximum allowable load current limit, the details of which are given in the following paragraphs. In some aspects, the current limited reference voltage $V_{ref_CL}$ enables the voltage error amplifier circuit 118 to regulate the output voltage Vout 112 to a current limited output voltage $V_{CL}$, during the current limit mode of operation. The current limited output voltage $V_{CL}$ comprises a voltage that is different from the regulated output voltage $V_{REG}$. The current limited output voltage $V_{CL}$ comprises a voltage that limits the current 117 to be equal to the predefined maximum allowable load current limit for a given resistance of the load circuit 104. Therefore, when the current limit circuit 106 modulates the output reference voltage Vout_ref 120 of the voltage error amplifier circuit 118 to form the current limited reference voltage $V_{ref_CL}$, the output voltage Vout is regulated by the voltage error amplifier circuit 118 to form the current limited output voltage $V_{CL}$, which in turn limits the current 117 to be equal to the predefined maximum allowable load current limit. Therefore, in this embodiment, since the voltage error amplifier circuit 118 regulates the output voltage Vout 112 based on the current limited reference voltage $V_{ref_CL}$, during the current limit operation mode, the voltage error amplifier circuit 118 is maintained in regulation, during the current limit operation mode. In this aspect, the current limited output voltage $V_{CL}$ is lower than the regulated output voltage $V_{REG}$. Alternately, in other aspects (e.g., in case of sinking regulators), where the load circuit 104 may be coupled between Vin 114 and Vout 112, the current limited output voltage $V_{CL}$ may be higher than the regulated output voltage $V_{REG}$.

In operation, as soon as current 117 reaches the predefined maximum allowable current limit, the linear regulator system 100 enters the current limit mode of operation, and the current limit circuit 106 will begin to modulate the output reference voltage Vout_ref 120 to create the current limited reference voltage $V_{ref_CL}$, in order to limit the load current from exceeding the predefined maximum allowable current limit. Specifically, when the output reference voltage Vout_ref 120 is modulated to form the current limited reference voltage $V_{ref_CL}$, the current 117 through the pass element 116 is limited to be equal to the predefined maximum allowable load current, thereby preventing the current 117 from exceeding the predefined maximum allowable load current limit. In some aspects, the current limit circuit 106 is adapted to modulate the output reference voltage Vout_ref 120 to form the current limited reference voltage $V_{ref_CL}$, until the current 117 through the pass element 116 becomes less than the predefined maximum allowable load current limit (e.g., as in regular operation mode).

Figure 1C:
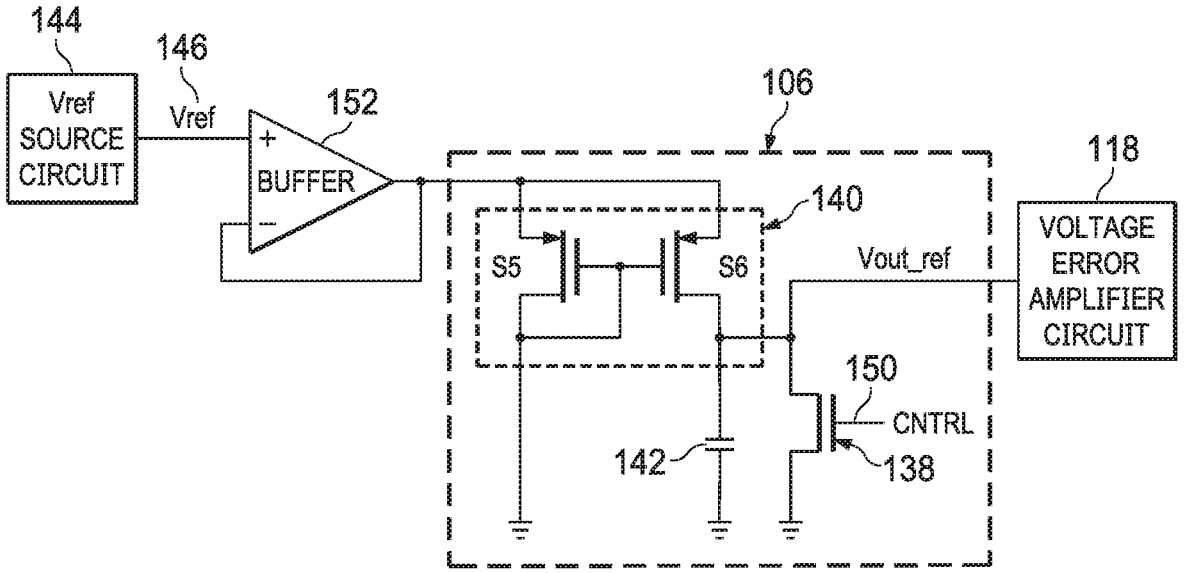
FIG. 1*c* illustrates an example implementation of a current limit circuit, according to one embodiment of the disclosure.

The current limit circuit 106 includes a current limit switch element 138 adapted to modulate the output reference voltage Vout_ref 120 of the voltage error amplifier circuit 118 to form the current limited reference voltage $V_{ref_CL}$, during the current limit operation mode. In some aspects, the current limit switch element 138 comprise three-terminal power semiconductor switch elements like MOSFETs, BJTs etc. In some aspects, a source/drain of the current limit switch element is coupled to the reference control terminal 132 of the reference switch element 124. The source/drain corresponds to the source/drain terminals of a MOSFET or emitter/collector terminals of a BJT. The current limit circuit 106 further includes an input filter circuit 139. The input filter circuit 139 includes a resistive element 140 and a capacitive element 142 coupled in series to one another. In some aspects, the resistive element 140 may be implemented using one or more power semiconductor switches, for example, as shown in FIG. 1*c*. Specifically, FIG. 1*c* depicts a resistive element 140 comprising a PMOS S5 and a PMOS S6. Alternately, in other embodiments, the resistive element 140 may be implemented differently, for example, using discrete resistors. The input filter circuit 139 is coupled between a Vref source circuit 144 (adapted to provide a reference voltage Vref 146) and the reference control terminal 132 of the reference switch element 124. In some aspects, the linear regulator circuit 100 may further comprise a buffer circuit 152 coupled between the Vref source circuit 144 and the current limit circuit 106, as shown in FIG. 1*c*. During the regular mode of operation, the reference switch element 124 is adapted to receive the output voltage reference Vout_ref 120 comprising a filtered version of the Vref 146. The current limit switch element 138 is adapted to be turned OFF during the regular mode of operation of the linear regulator core circuit 102, thereby having no effect on the output voltage reference Vout_ref 120. By turning OFF, it is meant that the current limit switch element 138 will be controlled to have a very high resistance (e.g., OFF resistance) such that the current limit switch element 138 acts as an open circuit, thereby not letting any current flow therethrough.

Linear regulator 100 enters the current limit operation mode when the current 117 through the pass element 116 increases to the predefined maximum allowable load current limit. When the current limit operation mode is initiated, the current limit switch element 138 is turned ON (with a specific ON resistance) in order to modulate the Vout_ref 120 to the current limited reference voltage Vref_CL value. Specifically, as soon as the current 117 reaches the predefined maximum allowable load current limit, the current limit switch element 138 is turned ON with the specific ON resistance, in order to modulate the Vout_ref 120. In particular, when the current limit switch element 138 is turned ON, the resistive element 140 of the input filter circuit 139 and the reference switch element 138 (or the ON resistance associated therewith) forms a voltage divider circuit, thereby modulating the Vout_ref 120 to the current limited reference voltage Vref_CL value. In some aspects, the current limited reference voltage Vref_CL value is a voltage divided version of the Vref 146. In some aspects, modulating the Vout_ref 120 at the reference control terminal 132 of the reference switch element 124, limits the current 117 to be equal to the predefined maximum allowable load current limit, thereby preventing the current 117 from exceeding the predefined maximum allowable load current limit. In some aspects, the current limit switch element 138 is adapted to be turned ON until the current 117 is less than the predefined maximum allowable load current limit. After current 117 is reduced to an acceptable value, linear regulator 100 may start maintaining regulation of the output voltage Vout 112 to $V_{REG}$.

The current limit switch element 138 is adapted to modulate the Vout_ref 120, based on a current limit control signal CNTRL 148 received at a current limit control terminal 150 associated therewith. In some aspects, the current limit control terminal 150 corresponds to the gate of a MOSFET or the base terminal of a BJT. The CNTRL 148 is adapted to turn OFF the current limit switch element 138 during the regular mode of operation of the linear regulator core circuit 102. Further, the CNTRL 148 is adapted to turn ON the current limit switch element 138 during the current limit operation mode of the linear regulator core circuit 102. The linear regular system 100 further includes a current limit amplifier circuit 108 adapted to generate the CNTRL 148 based on negative feedback. In some aspects, the CNTRL 148 is generated by the current limit amplifier circuit 108 based on current 117. Specifically, the current limit amplifier circuit 108 is adapted to compare a voltage, Vsense_CL, indicative of the current 117 with a Vref_load to generate the CNTRL 148. In some aspects, Vref_load corresponds to a voltage indicative of the predefined maximum allowable load current limit. In some aspects, a value of the Vref_load is user defined and may be hardwired.

During the regular operation mode, when the current 117 is less than the predefined maximum allowable load current limit, Vsense_CL is less than Vref_load. In such instances, the current limit switch element 138 is turned off by CNTRL 148 (e.g., if switch 138 is an NMOS transistor then CNTRL 148 will be at, or near, zero volts and if switch 138 is a PMOS transistor then CNTRL 148 will be at, or near, a voltage between 1.8V to 5V). When the current 117 approaches (or tries to exceed) the predefined maximum allowable load current limit (that is, when Vsense_CL becomes approximately equal to Vref_load), the CNTRL 148 signal is applied so that Vsense_CL remains approximately equal to Vref_load, Specifically, as the Vsense_CL increases to reach Vref_load, the current limit amplifier circuit 108 modulates the CNTRL 148 to turn ON the current limit switch element 138so that Vsense_CL is approximately equal to Vref_load, thereby limiting the current 117 to be equal to the predefined maximum allowable load current limit.

For example, when the current limit switch element 138 comprises an N-MOSFET, the CNTRL 148 may be equal to 0 V, during the regular operation mode of the linear regulator core circuit 102, in order to turn OFF the current limit switch element 138 and the CNTRL 148 may be around VDD, during the current limit operation mode of the linear regulator core circuit 102, in order to turn ON the current limit switch element 138 with the specific ON resistance. However, the value of the CNTRL 148 may vary for different switch types. In such aspects where the current limit switch element 138 comprises an N-MOSFET, the Vref_load may be provided to the inverting input of the current limit amplifier circuit 108 and the Vsense_CL may be provided to the non-inverting input of the current limit amplifier circuit 108, as shown in FIG. 1*a*. However, depending on the type of the current limit switch element 138, the connections may be inverted, in different embodiments, in order to obtain the required value of the CNTRL 148. In some aspects, the linear regulator system 100 further comprises a load current sense circuit 110 adapted to sense the current 117 and generate the voltage parameter Vsense_CL indicative of the load current. In other aspects, however, the load current sense circuit 110 may be adapted to generate a current parameter, for example, Isense_CL based on the current 117. In such aspects, the current limit amplifier circuit 108 may be configured to compare the Isense_CL with a reference current parameter Isense_CL indicative of the predefined maximum allowable load current limit, in order to generate the CNTRL 148.

Figure 2A:
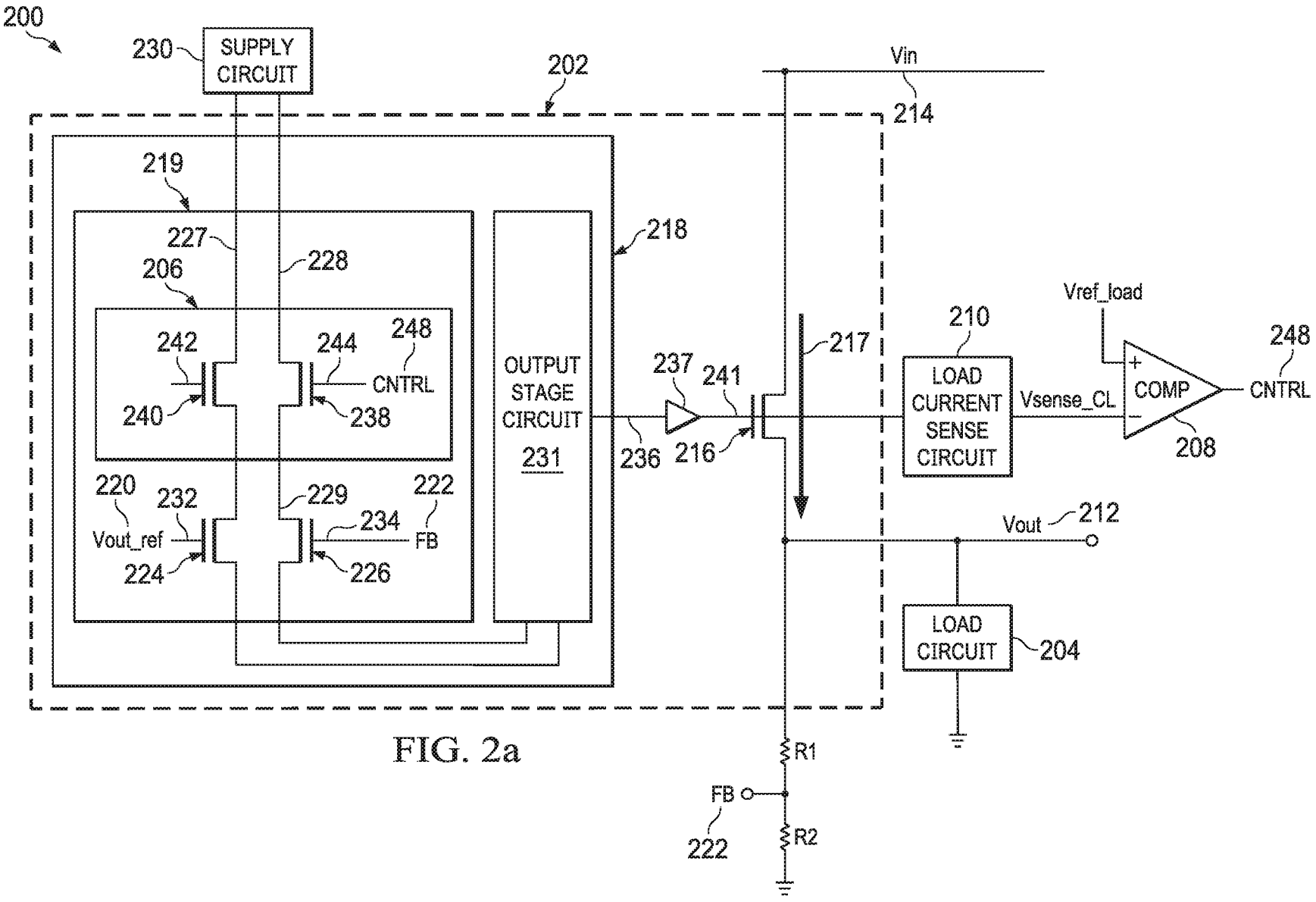
FIG. 2*a* illustrates a simplified block diagram of a linear regulator system, according to another aspect of the description.

FIG. 2*a* illustrates a simplified block diagram of a linear regulator system 200, according to another aspect of the disclosure. In some aspects, the linear regulator system 200 is adapted to provide a regulated output voltage to load circuits 204. The linear regulator system 200 comprises a linear regulator core circuit 202 adapted to provide an output voltage Vout 212 based on a supply voltage Vin 214. In some aspects, the linear regulator core circuit 202 is adapted to provide the output voltage Vout 212 to a load circuit 204 associated therewith. The linear regulator core circuit 202 includes a pass element 216 adapted to provide the output voltage Vout 212 based on the input voltage Vin 214. In some aspects, the pass element 216 includes a power semiconductor switch element like metal oxide semiconductor field effect transistor (MOSFET), bipolar junction transistors (BJT) etc. Alternately, in other embodiments, the pass element 216 may include a combination of one or more power semiconductor switch elements. The linear regulator core circuit 202 further includes a voltage error amplifier circuit 218 coupled to the pass element 216 and adapted to regulate the output voltage Vout 212 to form a regulated output voltage $V_{REG}$, which will be described in greater detail in the following paragraphs. In some aspects, the voltage error amplifier circuit 218 is coupled to a control terminal of the pass element 216. In some aspects, the control terminal corresponds to a gate of a MOSFET and a base terminal in case of BJTs. During regular operation, where current 117 remains less than a predefined maximum allowable load current, the voltage error amplifier circuit 218 is adapted to regulate the output voltage Vout 212 by altering the voltage at the gate of pass transistor 116 so that Vout remains at $V_{REG}$. The predefined maximum allowable load current limit is either hardwired into system 200, programmed into system 200 during final testing of system 200 or programmed after final test by an end-user (such as by connecting certain external circuit elements to system 200) and is the maximum current that should be allowed to flow through the pass element 216.

The voltage error amplifier circuit 218 is adapted to regulate the output voltage Vout 212 to the regulated output voltage $V_{REG}$, through negative feedback for example by comparing a feedback voltage FB 222 (based on the Vout 212) to an output reference voltage Vout_ref 220. The output reference voltage Vout_ref 220 can be defined by an end-user and feedback voltage FB 222 is based on a voltage divider circuit formed by R1, R2 and Vout 212. In particular, the voltage error amplifier circuit 218 generates a voltage error signal 236 based on the difference between the FB 222 and the Vout_ref 220, in order to regulate the output voltage Vout 112 to the regulated output voltage $V_{REG}$. Voltage error signal 236 is provided to a control terminal of the pass element 216 so as to alter the electrical characteristics of pass element 116. In some aspects, the voltage error signal 236 modulates a resistance of the pass element 216 to ensure that FB 222 and Vout_ref 220 at the input terminals of the voltage error amplifier circuit 218 are substantially equal, in order to regulate the Vout 212 to form the regulated output voltage $V_{REG}$. In some aspects, a value of the Vout_ref 220 is chosen in a way that, when the FB 222 and the Vout_ref 220 at the input terminals of the voltage error amplifier circuit 218 are equal, Vout 212 is regulated to form the regulated output voltage $V_{REG}$. The FB 222 is indicative of the Vout 212. In some aspects, FB 222 is same as the Vout 212. Alternately, in other aspects, the FB 222 may be different from the Vout 212. For example, in some aspects, the FB 222 may be derived from Vout 212 using the voltage divider arrangement comprising R1 and R2.

The voltage error amplifier circuit 218 includes an input stage circuit 219 comprising a first circuit leg 227 and a second circuit leg 228, both of which are coupled to a supply circuit 230. In some aspects, the first circuit leg 227 and the second circuit leg 228 are equivalent to a first circuit path and a second circuit path, respectively. In some aspects, the first circuit leg 227 and the second circuit leg 228 are arranged in parallel with respect to one another. The supply circuit 230 may comprise a voltage source (such as a positive supply source (e.g., Vin) or a negative supply source (e.g., ground)) and/or a current source. The first circuit leg 227 includes a reference switch element 224 and the second circuit leg 228 includes a feedback switch element 226. In some aspects, the reference switch element 224 and the feedback switch element 226 comprise three-terminal semiconductor switch elements like MOSFETs, BJTs etc. In some aspects, the reference switch element 224 and the feedback switch element 226 are symmetrically arranged with respect to one another. In some aspects, the reference switch element 224 and the feedback switch element 226 comprise the same type of power semiconductor switch element. However, in other aspects, the reference switch element 224 and the feedback switch element 226 may comprise different types of power semiconductor switch elements. The reference switch element 224 is adapted to receive the output reference voltage Vout_ref 220 at a reference control terminal 232 associated therewith. In some aspects, the reference control terminal 232 corresponds to a gate terminal in case of MOSFETs and base terminal in case of BJTs. The feedback switch element 226 is adapted to receive the FB voltage 222 at a feedback control terminal 234 associated therewith. In some aspects, the feedback control terminal 234 corresponds to a gate terminal in case of MOSFETs and base terminal in case of BJTs.

Figure 2B:
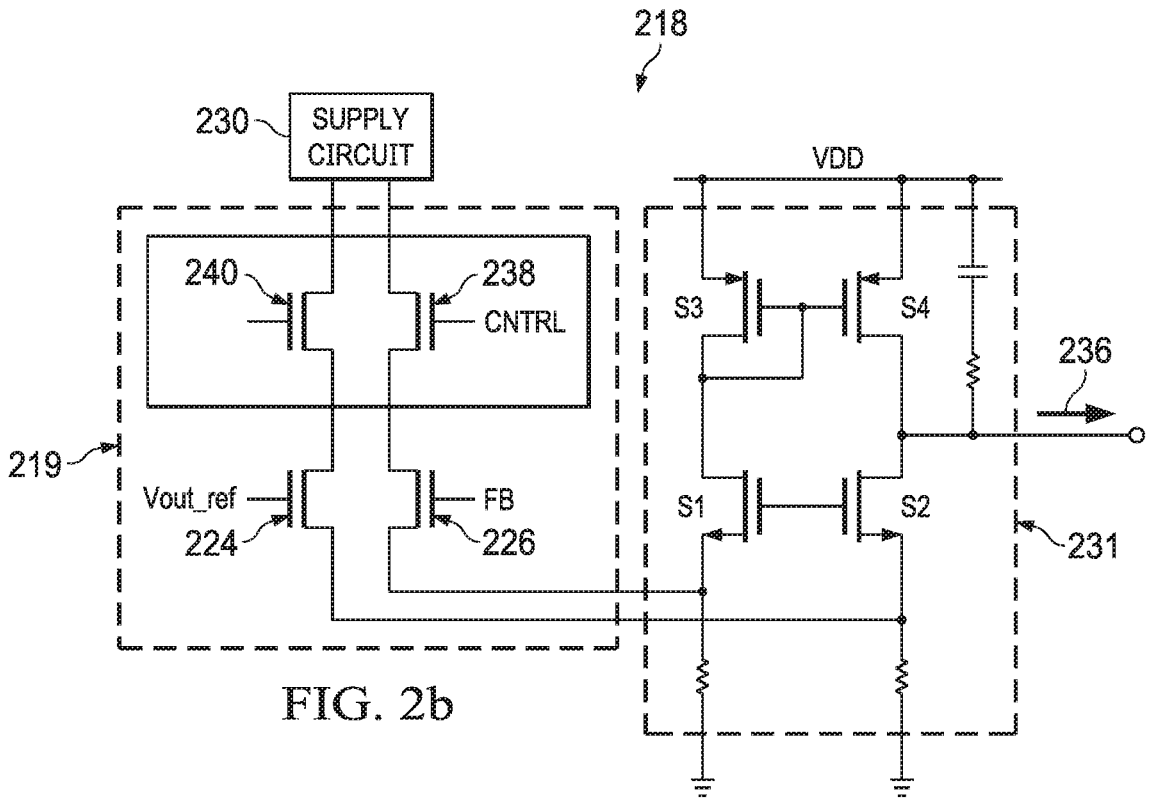
FIG. 2*b* illustrates one possible implementation of an output stage circuit of a voltage error amplifier circuit, according to one embodiment of the disclosure.

The voltage error amplifier circuit 218 further includes an output stage circuit 231 coupled to the input stage circuit 219 and adapted to generate the voltage error signal 236 to be provided to the pass element 216. In some aspects, the output stage circuit 231 includes resistors or a combination of resistors and semiconductor switch elements configured to generate the voltage error signal 236 based on the difference between the output reference voltage Vout_ref 220 and the FB voltage 222. The output stage circuit 231 may be implemented differently in different embodiments. FIG. 2*b* illustrates one possible implementation of the output stage circuit 231. Specifically, the output stage circuit 231 comprises an NMOS S1, a source terminal of which is coupled to the feedback switch element 226. Further, the output stage circuit 231 comprises an NMOS S2, a source terminal of which is coupled to the reference switch element 224. The gate terminals of the NMOS S1 and the NMOS S2 are coupled to one another. In addition, the output stage circuit 231 comprises a current mirror arrangement comprising a PMOS S3 and a PMOS S4. In some aspects, the output stage circuit 231 is configured to provide the voltage error signal 236, based on a difference between the output reference voltage Vout_ref 220 and the FB voltage 222 at an output terminal associated therewith. However, other implementations of the output stage circuit 231 are also contemplated to be within the scope of this disclosure. In some aspects, the linear regulator core circuit 202 further includes a buffer/gate driver circuit 237 coupled between the voltage error amplifier circuit 218 and the pass element 216, and adapted to generate a gate driver signal 241 based on the voltage error signal 236. Alternately, the buffer/gate driver circuit 237 may not be present. In such aspects, the voltage error signal 236 may be directly provided to the control terminal of the pass element 216.

As indicated above, in some aspects, the voltage error amplifier circuit 218 is adapted to regulate the output voltage Vout 212 to form the regulated output voltage $V_{REG}$ during a regular mode of operation of the linear regulator core circuit 202 when the current 217 through the pass element 216 is less than the predefined maximum allowable load current limit. In certain circumstances in order to maintain the regulated output voltage $V_{REG}$, the current 217 through the pass element 216 may increase to the predefined maximum allowable load current limit. For example, when the resistance of load circuit 204 is less than a predefined load resistance limit, the current 217 may exceed the predefined maximum allowable load current limit if the regulated output voltage $V_{REG}$ is to be maintained. A load current larger than the predefined maximum allowable load current limit may cause damage to the pass element 216. In some example embodiments, linear regulator system 200 will enter into a current limit operation mode when the current 217 through pass transistor 216 approaches (or tries to exceed) the predefined maximum allowable load current limit.

In order to limit the current 217 from exceeding the predefined maximum allowable load current limit, the input stage circuit 219 further includes a current limit circuit 206. Specifically, the current limit circuit 206 modulates the output reference voltage Vout_ref 220 of the voltage error amplifier circuit 218 to form a current limited reference voltage $V_{ref_CL}$, in order to limit the current 217 through the pass element 216 from exceeding the predefined maximum allowable load current limit, further details of which are given in paragraphs below. In some aspects, the current limited reference voltage $V_{ref_CL}$ enables the voltage error amplifier circuit 218 to regulate the output voltage Vout 212 to a current limited output voltage $V_{CL}$, during the current limit mode of operation. The current limited output voltage $V_{CL}$ comprises a voltage that is different from the regulated output voltage $V_{REG}$. The current limited output voltage $V_{CL}$ comprises a voltage that limits the current 217 through the pass element 216 to be equal to the predefined maximum allowable load current limit for a given resistance of the load circuit 204. Therefore, when the current limit circuit 206 modulates the output reference voltage Vout_ref 220 of the voltage error amplifier circuit 218 to form a current limited reference voltage $V_{ref_CL}$, the output voltage Vout 212 is regulated by the voltage error amplifier circuit 118 to form the current limited output voltage $V_{CL}$, which in turn limits the current 217 to be equal the predefined maximum allowable load current limit. Therefore, in this embodiment, since the voltage error amplifier circuit 218 regulates the output voltage Vout 212 based on the current limited reference voltage $V_{ref_CL}$, during the current limit operation mode, the voltage error amplifier circuit 118 is maintained in regulation, during the current limit operation mode. In this aspect, the current limited output voltage $V_{CL}$ is lower than the regulated output voltage $V_{REG}$. Alternately, in other aspects, (e.g., in case of sinking regulators), where the load circuit 204 may be coupled between Vin 214 and Vout 212, the current limited output voltage $V_{CL}$ may be higher than the regulated output voltage $V_{REG}$.

In operation, as soon as current 217 reaches the maximum allowable current limit, the linear regulator system 100 enters the current limit mode of operation, and the current limit circuit 206 will begin to modulate the output reference voltage Vout_ref 220 to create the current limited reference voltage $V_{ref_CL}$, in order to limit the current 217 from exceeding the predefined maximum allowable current limit. Specifically, when the output reference voltage Vout_ref 220 is modulated to form the current limited reference voltage $V_{ref_CL}$, the current 217 through the pass element 216 is limited to be equal to the predefined maximum allowable load current, thereby preventing the current 217 from exceeding the predefined maximum allowable load current limit. In some aspects, the current limit circuit 206 is adapted to modulate the output reference voltage Vout_ref 120 to form the current limited reference voltage $V_{ref_CL}$, until the current 217 through the pass element 216 becomes less than the predefined maximum allowable load current limit (e.g., as in regular operation mode).

In this example embodiment, the current limit circuit 206 is adapted to modulate a voltage that appears at a source of the feedback switch element 226, in order to modulate output reference voltage Vout_ref 220. In the voltage error amplifier circuit 218, the output reference voltage Vout_ref 220 applied to the reference control terminal 232 appears at a source of the feedback switch element 226, if the current limit circuit 206 were not included. Therefore, modulating the voltage that appears at the source terminal of the feedback switch element 226 is equivalent to modulating the output reference voltage 220 at the reference control terminal 232. Therefore, the current limit circuit 206 is adapted to modulate the output reference voltage Vout_ref 220 to form the current limited reference voltage $V_{ref_CL}$, based on modulating the voltage that appears at the source terminal of the feedback switch element 226. In some aspects, the source terminal is equivalent to a source terminal in case of MOSFETs and emitter terminal in case of BJTs.

The current limit circuit 206 includes a current limit switch element 238 and a symmetrical switch element 240. In some aspects, the current limit switch element 238 comprises three-terminal semiconductor switch elements like MOSFETs, BJTs etc. In some aspects, the current limit control terminal 244 corresponds to a gate of a MOSFET or a base of a BJT. The current limit switch element 238 is coupled to the second circuit leg 228 in series with the feedback switch element 226. In some aspects, the source/drain of the current limit switch element 238 is coupled to the source/drain of the feedback switch element 226 to form the series connection between the current limit switch element 238 and the feedback switch element 226. The source/drain corresponds to the source/drain terminals of a MOSFET or emitter/collector terminals of a BJT. The symmetrical switch element 240 is coupled to the first circuit leg 227 in series with the reference switch element 224. In some aspects, the symmetrical switch element 240 comprise three-terminal semiconductor switch elements like MOSFETs, BJTs etc. In some aspects, the symmetrical control terminal 242 corresponds to a gate of a MOSFET or a base of a BJT. In some aspects, a source/drain of the symmetrical switch element 240 is coupled to source/drain of the reference switch element 224 to form the series connection between the symmetrical switch element 240 and the reference switch element 224. In some aspects, a resistance of the current limit switch element 238 is modulated, in order to modulate the output reference voltage Vout_ref 220 that appears at the source of the feedback switch element 226.

During the regular operation mode of the linear regulator core circuit 202, when the current 217 is less than the predefined maximum allowable load current limit, the current limit switch element 238 is adapted to be in a fully ON state, thereby causing no effect on the output reference voltage Vout_ref 220 that appears at the source terminal (say terminal 229) of the feedback switch element 226. Specifically, during the regular operation mode of the linear regulator core circuit 202, the current limit switch element 238 is adapted to act like a short (i.e., with negligible resistance). Linear regulator 200 enters the current limit operation mode, when the current 217 through the pass element 216 increases to the predefined maximum allowable load current limit. When the current limit mode is initiated a resistance of the current limit switch element 238 is modulated to a modulated ON resistance. Specifically, as soon as the current 217 reaches the predefined maximum allowable load current limit, the resistance of the current limit switch element 238 is modulated to the modulated ON resistance. The modulated ON resistance of the current limit switch element 230 comprises a resistance associated with an ON state of the current limit switch element 238 and is greater than a resistance of the current limit switch element 238 in a fully ON state. In some aspects, modulating the ON resistance of the current limit switch element 238 varies/modulate the Vout_ref 220 that appears at the source terminal of the feedback switch element 226 to form the current limited reference voltage $V_{ref_CL}$.

In some aspects, modulating the Vout_ref 220 at the source terminal of the feedback switch element 226 comprises changing/adapting the Vout_ref 220 that appears at the source terminal of the feedback switch element 226. In some aspects, the Vout_ref 220 that appears at the source terminal of the feedback switch element 226 is modulated to form the current limited reference voltage Vref_CL such that the current 217 is limited to be equal to the predefined maximum allowable load current limit, thereby preventing the current 217 from exceeding the predefined maximum allowable load current limit. In some aspects, the resistance of the current limit switch element 238 is modulated to the modulated ON resistance, until the current 217 through the pass element 216 becomes less than the predefined maximum allowable load current limit. The symmetrical switch element 240 is adapted to be in the fully ON state during the regular operation mode and the current limit operation mode. In some aspects, the symmetrical switch element 240 is provided to maintain symmetry between the first circuit leg 227 and the second circuit leg 228.

The current limit switch element 238 is adapted to modulate the Vout_ref 220, based on a current limit control signal CNTRL 248 received at a current limit control terminal 244 associated therewith. Specifically, the CNTRL 248 is adapted to turn the current limit switch element 238 into the fully ON state during the regular mode of operation of the linear regulator core circuit 202. Further, the CNTRL 248 is adapted to modulate the ON resistance of the current limit switch element 238 in to the modulated ON resistance, during the current limit operation mode of the linear regulator core circuit 202. The linear regular system 200 further includes a current limit amplifier circuit 208 configured to generate the CNTRL 248. The CNTRL 248 is generated by the current limit amplifier circuit 208 based on the current 217. Specifically, the current limit amplifier circuit 208 is adapted to compare a voltage, Vsense_CL indicative of the load current with a load current limit reference Vref_load to generate the CNTRL 248. In some aspects, Vref_load corresponds to a voltage indicative of the predefined maximum allowable load current limit. During the regular operation mode, when the current 217 is less than the predefined maximum allowable load current limit, Vsense_CL is less than Vref_load. In such instances, the current limit amplifier circuit 208 is adapted to generate the CNTRL 248 having a value that turns the current limit switch element 238 into the fully ON state.

When the current 217 approaches (or becomes equal to) the predefined maximum allowable load current limit (that is, when Vsense_CL becomes approximately equal to Vref_load), the CNTRL 248 is varied to ensure that Vsense_CL remains approximately equal to Vref_load. Specifically, as the Vsense_CL increases to reach Vref_load, the current limit amplifier circuit 208 modulates the CNTRL 248 to modulate the resistance of the current limit switch element 238 to a modulated ON resistance to ensure that Vsense_CL is approximately equal to Vref_load, thereby limiting the current 217 to be equal to the predefined maximum allowable load current limit. In one example implementation, when the current limit switch element 138 comprises an N-MOSFET, the CNTRL 248 may be equal to VDD, during the regular operation mode of the linear regulator core circuit 102, in order to turn the current limit switch element 138 into the fully ON state and the CNTRL 148 is varied from VDD in order to modulate the ON resistance of the current limit switch element 238 into the modulated ON resistance, during the current limit operation mode. However, the value of the CNTRL 148 during the regular operation mode and the current limit operation mode may vary for different switch types. For example, if the current limit switch element 338 comprises a P-MOSFET, the current limit amplifier circuit 308 may be adapted to generate the CNTRL 348 to be equal to 0, in order to keep the current limit switch element 338 in the fully ON state, during the regular mode of operation.

In this embodiment, the Vref_load is shown to be provided to the non-inverting terminal of the current limit amplifier circuit 208 and the Vsense_CL is shown to be provided to the inverting terminal of the current limit amplifier circuit 108. However, the connections associated with the current limit amplifier 208 are for illustrative purpose only and is not construed to be limited to this particular implementation. Depending on the type of the current limit switch element 238, the connections may be inverted, in different embodiments, in order to obtain the required value of the CNTRL 248. In some aspects, the linear regulator system 200 further comprises a load current sense circuit 210 adapted to sense the current 217 and generate the voltage parameter Vsense_CL indicative of the load current. In other aspects, however, the load current sense circuit 210 may be adapted to generate a current parameter, for example, Isense_CL based on the current 217. In such aspects, the current limit amplifier circuit 208 may be configured to compare the Isense_CL with a reference current parameter Isense_CL indicative of the predefined maximum allowable load current limit.

Figure 2C:
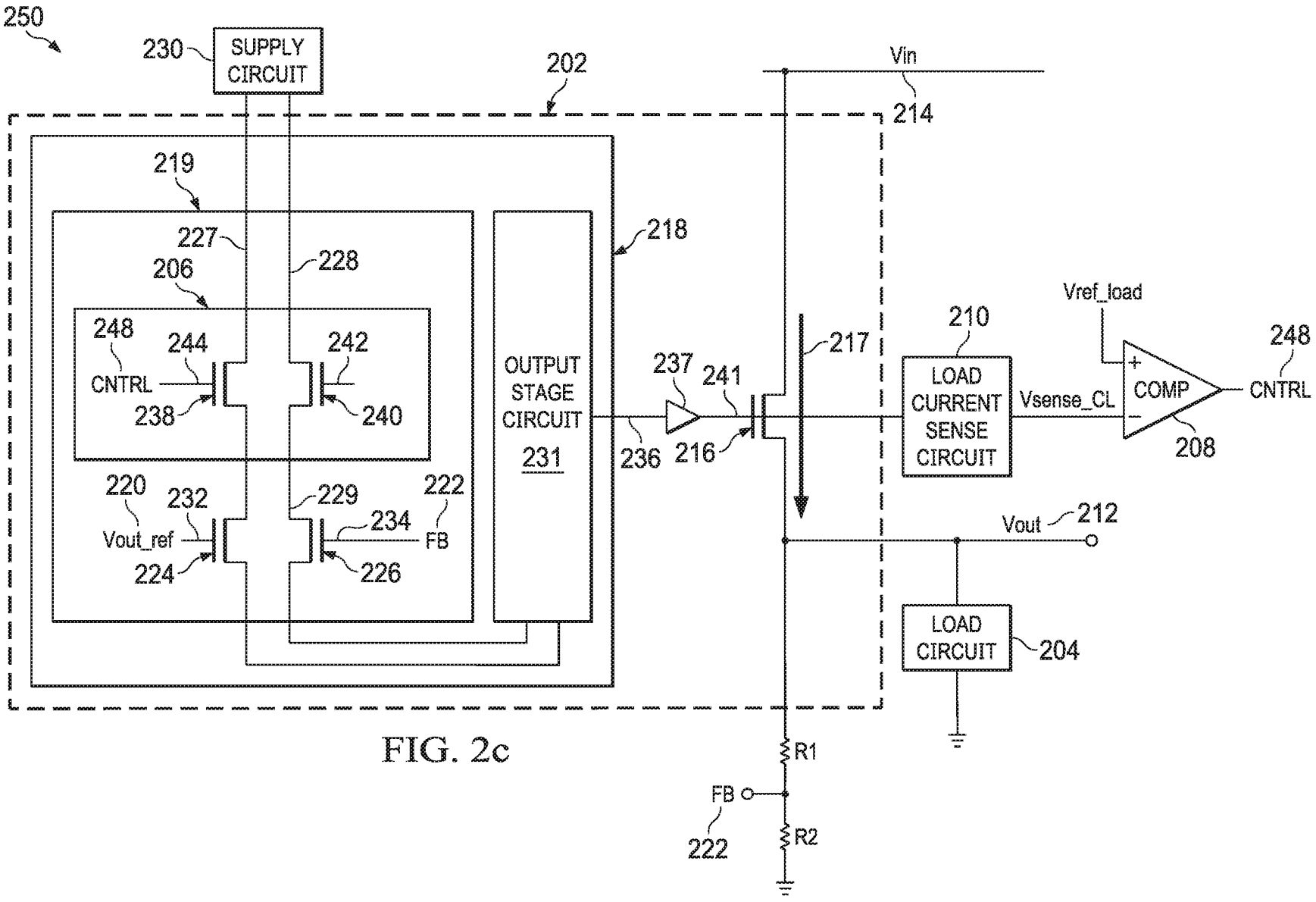
FIG. 2*c* illustrates a simplified block diagram of a linear regulator system, according to yet another aspect of the description.

In FIG. 2*a*, the current limit switch element 238 is shown to be coupled to the second circuit leg 228 in series with the feedback switch element 226 and symmetrical switch element 240 is shown to be coupled to the first circuit leg 227 in series with the reference switch element 224. However, in other implementations, the current limit switch element 238 may be coupled to the first circuit leg 227 in series with the reference switch element 224 and the symmetrical switch element 240 may be coupled to the second circuit leg 228 in series with the feedback switch element 226, as shown in the linear regulator system 250 in FIG. 2*c*. All the other features of the linear regulator system 250 in FIG. 2*c* is similar to the linear regulator system 200 in FIG. 2*a* and is therefore not repeated herein. While the example of embodiment depicted in FIG. 2*a* shows current limit circuit 206 situated between supply circuit 230 and switches 224 and 226, depending on the type of switches used in the input stage circuit 219, the current limit circuit 206 may be situated between output stage circuit 231 and switches 224 and 226, as shown in FIG. 2*c*. In general, the current limit switch element 238 may be coupled in series to either the feedback switch element 226 or the reference switch element 224 as long as negative feedback is applied in the circuit path from the current limit switch element 238 to the output of the current limit amplifier circuit 208. Specifically, for negative feedback, an odd number of inversions in the circuit path from the current limit switch element 238 to the output of the current limit amplifier circuit 208 should be applied. Further, a position of the current limit circuit 206 with respect to the source circuit 230 and the output stage circuit 231 is chosen in a way that a modulation of the resistance of the current limit switch element 238 would result in a change in the voltage that appears at the source of the feedback switch element 226.

Figure 3A:
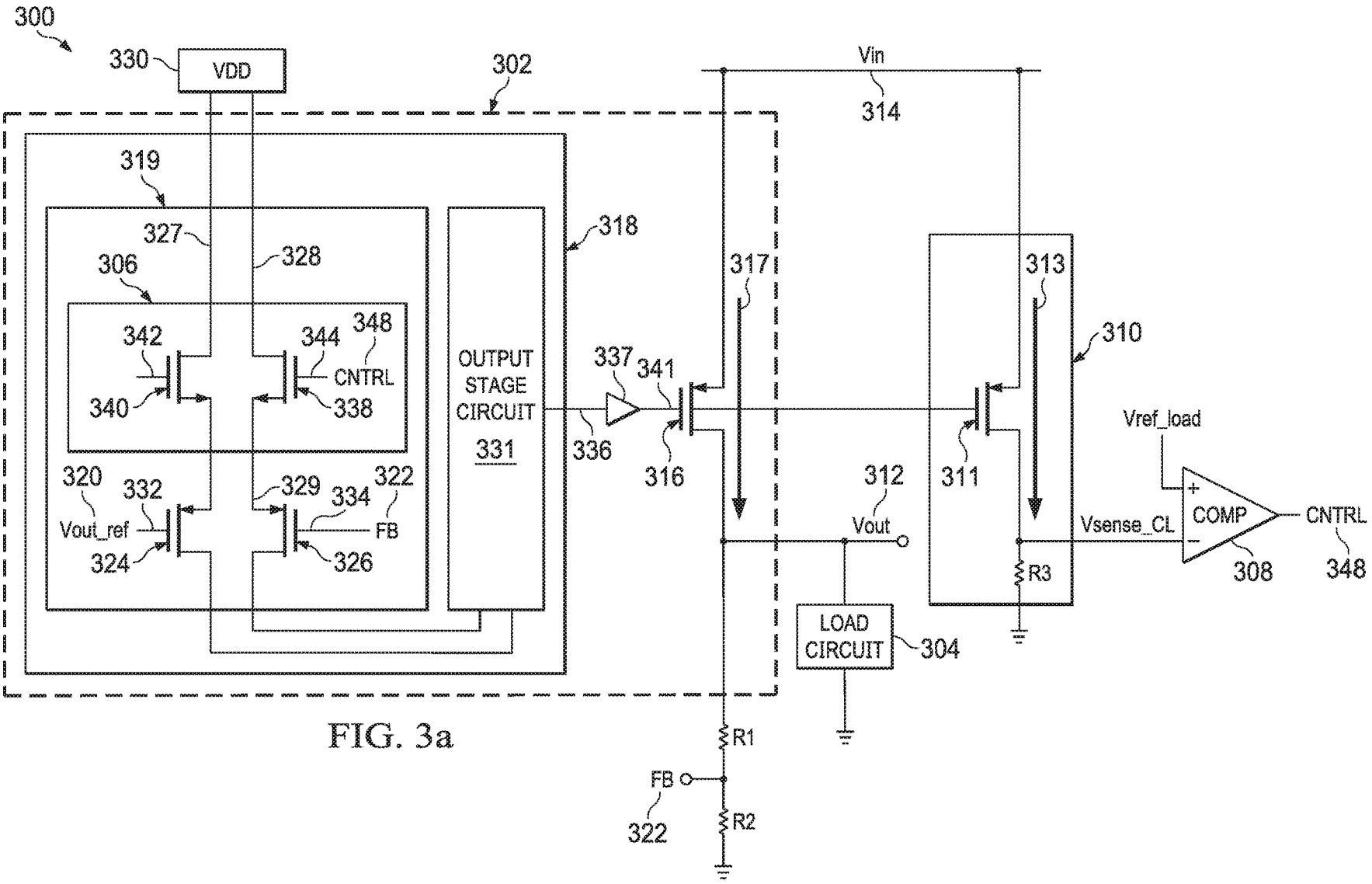
FIGS. 3*a*-3*b* are example implementations of a linear regulator system, according to various aspects described in the description.

FIG. 3*a* is an example implementation of a linear regulator system 300, according to one aspect of the description. In some aspects, the linear regulator system 300 comprises one possible way of implementation of the linear regulator system 200 in FIG. 2*a* and therefore, all the features of the linear regulator system 200 in FIG. 2*a* is also applicable to the linear regulator system 300 in FIG. 3*a*. The linear regulator system 300 comprises a linear regulator core circuit 302 configured to provide an output voltage Vout 312 based on a supply voltage Vin 314. In some aspects, the linear regulator core circuit 302 is configured to provide the output voltage to a load circuit 304. The linear regulator core circuit 302 includes a pass element 316 configured to provide the output voltage Vout 312 based on the input voltage Vin 314. In this aspect, the pass element 316 comprises a P-MOSFET. Alternately, in other embodiments, the pass element 316 may comprise other power semiconductor switch elements (such as an NMOSFET or a BJT) or a combination of one or more power semiconductor switch elements. The linear regulator core circuit 302 further includes a voltage error amplifier circuit 318 coupled to the pass element 316 and configured to regulate the output voltage Vout 312, further details of which are given in paragraphs below. In some aspects, the voltage error amplifier circuit 318 is coupled to a control terminal of the pass element 316. In some aspects, the control terminal corresponds to a gate of a MOSFET and a base terminal in case of BJTs. During regular operation, where current 317 remains less than a predefined maximum allowable load current, the voltage error amplifier circuit 318 is adapted to regulate the output voltage Vout 312 by altering the voltage at the gate of pass transistor 116 so that Vout remains at $V_{REG}$. The predefined maximum allowable load current limit is either hardwired into system 300, programmed into system 300 during final testing of system 300 or programmed after final test by an end-user (such as by connecting certain external circuit elements to system 300) and is the maximum current that should be allowed to flow through the pass element 316.

The voltage error amplifier circuit 318 is adapted to regulate the output voltage Vout 312 through negative feedback, to form the regulated output voltage $V_{REG}$, based on comparing a feedback voltage FB 322 (based on the Vout 312) to an output reference voltage Vout_ref 320. In particular, the voltage error amplifier circuit 318 generates a voltage error signal 336 based on the difference between the FB 322 and the Vout_ref 320, to be provided to a gate terminal of the pass element 316. In some aspects, the voltage error signal 336 modulates a resistance of the pass element 316 to ensure that FB 322 and Vout_ref 320 at the input terminals of the voltage error amplifier circuit 318 are equal, in order to regulate the Vout 312 to form the regulated output voltage $V_{REG}$. The voltage error amplifier circuit 318 includes an input stage circuit 319 comprising a first circuit leg 327 and a second circuit leg 328, both of which are coupled to a supply circuit 330. In this aspect, the supply circuit 230 comprises a positive supply source (e.g., Vin). The first circuit leg 327 includes a reference switch element 324 and the second circuit leg 328 includes a feedback switch element 326. In this aspect, the reference switch element 324 and the feedback switch element 326 comprise P-MOSFETs. Further, the reference switch element 324 and the feedback switch element 326 are symmetrically arranged with respect to one another. The reference switch element 324 is adapted to receive the output reference voltage Vout_ref 320 at a gate terminal 332 associated therewith. The feedback switch element 326 is adapted to receive the FB voltage 322 at a gate terminal 334 associated therewith.

The voltage error amplifier circuit 318 further includes an output stage circuit 331 coupled to the input stage circuit 319 and adapted to generate the voltage error signal 336 to be provided to the pass element 316. In some aspects, the output stage circuit 331 may be implemented similar to the output stage circuit 231 illustrated in FIG. 2*b*. However, other implementations of the output stage circuit 331 are also contemplated to be within the scope of this disclosure. In some aspects, the linear regulator core circuit 302 further comprises a buffer/gate driver circuit 337 coupled between the voltage error amplifier circuit 318 and the pass element 316, and adapted to generate a gate driver signal 341 based on the voltage error signal 336.

In some aspects, for example, when a load resistance associated with the load circuit 304 is reduced to be less than a predefined load resistance limit, the current 317 through the pass element 316 may exceed the predefined maximum allowable load current limit, if the regulated output voltage $V_{REG}$ is to be maintained. A load current larger than the predefined maximum allowable load current limit may cause damage to the pass element 316. In some example embodiments, the linear regulator system 300 will enter into a current limit operation mode when the current 317 through pass transistor 316 approaches (or tries to exceed) the predefined maximum allowable load current limit. In order to limit the current 317 from exceeding the predefined maximum allowable load current limit, the input stage circuit 319 further includes a current limit circuit 306. Specifically, the current limit circuit 306 modulates the output reference voltage Vout_ref 320 of the voltage error amplifier circuit 318 to form a current limited reference voltage $V_{ref_CL}$, during the current limit operation mode. In some aspects, the current limited reference voltage $V_{ref_CL}$ enables the voltage error amplifier circuit 318 to regulate the output voltage Vout 312 to a current limited output voltage $V_{CL}$ that limits the current 317 through the pass element 316 to be equal to the predefined maximum allowable load current limit, as explained above with respect to FIG. 2*a*, In operation, as soon as current 317 reaches the maximum allowable current limit, the linear regulator system 300 enters the current limit mode of operation, and the current limit circuit 306 will begin to modulate the output reference voltage Vout_ref 320 to create the current limited reference voltage $V_{ref_CL}$, in order to limit the load current from exceeding the predefined maximum allowable current limit. Specifically, when the output reference voltage Vout_ref 320 is modulated to form the current limited reference voltage $V_{ref_CL}$, the current 317 through the pass element 316 is limited to be equal to the predefined maximum allowable load current, as explained above with respect to FIG. 2*a*.

In some aspects, the output reference voltage Vout_ref 320 applied to the gate terminal 332 of the reference switch element 324 appears at a source terminal 329 of the feedback switch element 326, as explained above with respect to FIG. 2*a*. Therefore, modulating the output reference voltage Vout_ref 320 that appears at the source terminal 329 of the feedback switch element 326 is equivalent to modulating the output reference voltage 320 at the reference control terminal 332. The current limit circuit 306 is therefore adapted to modulate the output reference voltage Vout_ref 320 to form the current limited reference voltage $V_{ref_CL}$, based on modulating the output reference voltage Vout_ref 320 that appears at the source terminal 329 of the feedback switch element 326.

The current limit circuit 306 includes a current limit switch element 338 and a symmetrical switch element 340. In this aspect, both the current limit switch element 338 and a symmetrical switch element 340 comprise N-MOSFETs. The current limit switch element 338 is coupled to the second circuit leg 328 in series with the feedback switch element 326. In this aspect, a source terminal of the current limit switch element 338 is coupled to the source terminal of the feedback switch element 326 to form the series connection between the current limit switch element 338 and the feedback switch element 326. The symmetrical switch element 340 is coupled to the first circuit leg 327 in series with the reference switch element 324. In this aspect, a source terminal of the symmetrical switch element 340 is coupled to a source terminal of the reference switch element 324 to form the series connection between the symmetrical switch element 340 and the reference switch element 324. In some aspects, a resistance of the current limit switch element 338 is modulated, in order to modulate the output reference voltage Vout_ref 320 that appears at the source terminal of the feedback switch element 326.

During the regular operation mode of the linear regulator core circuit 302, when the current 317 through the pass element 316 is less than the predefined maximum allowable load current limit, the current limit switch element 338 is adapted to be in a fully ON state, thereby causing no effect on the output reference voltage Vout_ref 320 that appears at the source terminal of the feedback switch element 326. Specifically, during the regular operation mode of the linear regulator core circuit 302, the current limit switch element 338 is adapted to act like a short (i.e., with negligible resistance). Linear regulator 300 enters the current limit operation mode, when the current 317 through the pass element 316 increases to the predefined maximum allowable load current limit. When the current limit mode is initiated, a resistance of the current limit switch element 338 is modulated to a modulated ON resistance. Specifically, as soon as the current 317 reaches the predefined maximum allowable load current limit, the resistance of the current limit switch element 338 is modulated to the modulated ON resistance. The modulated ON resistance of the current limit switch element 338 comprises a resistance associated with an ON state of the current limit switch element 338 and is greater than a resistance of the current limit switch element 238 in a fully ON state. In some aspects, modulating the ON resistance of the current limit switch element 338 varies/modulate the Vout_ref 320 that appears at the source terminal of the feedback switch element 326 to form the current limited reference voltage Vref_CL. In some aspects, the Vout_ref 320 that appears at the source terminal of the feedback switch element 326 is modulated to form the current limited reference voltage Vref_CL such that the current 317 is limited from exceeding the predefined maximum allowable load current limit. In some aspects, the resistance of the current limit switch element 338 is maintained at the modulated ON resistance, until the current 317 through the pass element 316 becomes less than the predefined maximum allowable load current limit. The symmetrical switch element 340 is adapted to be in the fully ON state during the regular operation mode and the current limit operation mode.

The current limit switch element 338 is adapted to modulate the Vout_ref 320, based on a current limit control signal CNTRL 348 received at a gate terminal 344 associated therewith. Specifically, the CNTRL 348 is adapted to turn the current limit switch element 338 into the fully ON state during the regular mode of operation of the linear regulator core circuit 302. Further, the CNTRL 348 is adapted to modulate the ON resistance of the current limit switch element 338 in to the modulated ON resistance, during the current limit operation mode of the linear regulator core circuit 302. In this aspect, since the current limit switch element 338 comprises an N-MOSFET, the CNTRL 348 is adapted to be equal to VDD, during the regular operation mode of the linear regulator core circuit 202, in order to turn the current limit switch element 338 into the fully ON state and the CNTRL 348 is varied from VDD in order to modulate the ON resistance of the current limit switch element 338 into the modulated ON resistance during the current limit operation mode. However, the value of the CNTRL 348 may vary for different switch types.

The linear regular system 300 further includes a current limit amplifier circuit 308 adapted to generate the CNTRL 348, based on negative feedback. The CNTRL 348 is generated by the current limit amplifier circuit 308 based on the current 317. Specifically, the current limit amplifier circuit 308 is adapted to compare a voltage, Vsense_CL indicative of the load current with a load current limit reference Vref_load to generate the CNTRL 348. In some aspects, Vref_load corresponds to a voltage parameter indicative of the predefined maximum allowable load current limit. During the regular operation mode, when the current 317 is less than the predefined maximum allowable load current limit, Vsense_CL is less than Vref_load. Since the current limit switch element 338 comprises an N-MOSFET, the current limit amplifier circuit 308 is adapted to generate the CNTRL 348 to be equal to VDD, in order to keep the current limit switch element 338 in the fully ON state, during the regular operation mode. During the current limit operation mode, when the current 317 approaches (or becomes equal to) the predefined maximum allowable load current limit, the CNTRL 348 is varied to modulate the resistance of the current limit switch element 338 to the modulated ON resistance, in order to ensure that Vsense_CL remains approximately equal to Vref_load. In other words, as the Vsense_CL increases to reach Vref_load, the CNTRL 348 is varied to ensure that the current 317 remains approximately equal to the predefined maximum allowable load current limit.

In this embodiment, the Vref_load is applied to the non-inverting input of current limit amplifier circuit 308 and the Vsense_CL is applied to the inverting input of current limit amplifier circuit 308 to generate the CNTRL 348 signal. However, depending on the type of the current limit switch element 338, the terminals may be inverted, in different embodiments, in order to obtain the required value of the CNTRL 348. In some aspects, the linear regulator system 300 further comprises a load current sense circuit 310 adapted to sense the current 317 and generate the voltage parameter Vsense_CL, which is indicative of the load current. Specifically, in this embodiment, the load current sense circuit 310 comprises a sense switch element 311 that senses the current 317 and provides a sensed load current 313 comprising a fraction of the current 317. In some aspects, a size of the sense switch element 311 is chosen in a way that the sensed load current 313 comprises a fraction of the current 317. The load current sense circuit 310 further comprises a sense resistor R3. Vsense_CL is the product of R3 and the sensed load current 313. In other aspects, however, the load current sense circuit 310 may be adapted to generate a current parameter, for example, Isense_CL based on the current 317. In such aspects, the current limit amplifier circuit 308 may be configured to compare the Isense_CL with a reference current parameter Iref_load indicative of the predefined maximum allowable load current limit.

Figure 3B:
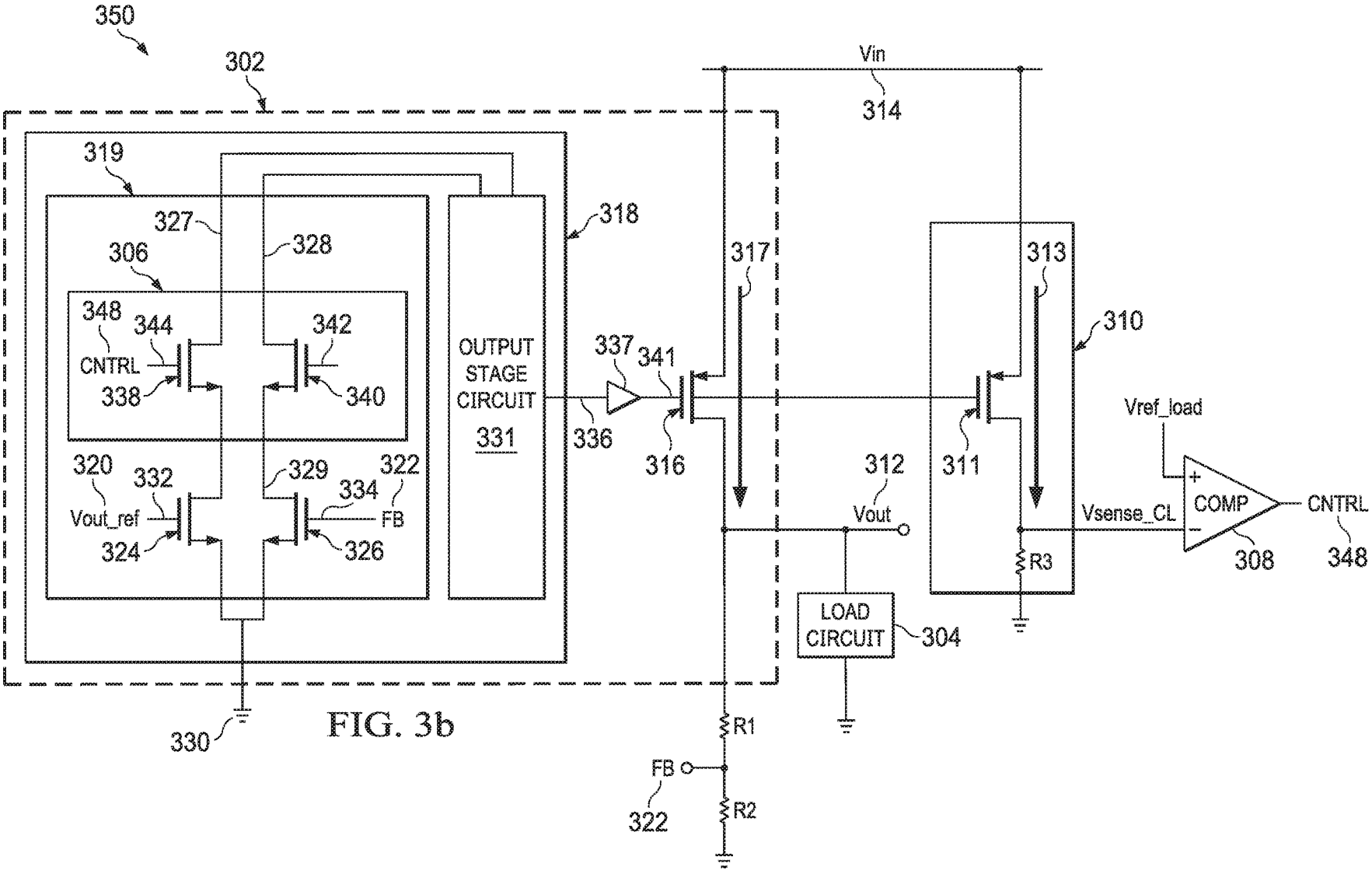
Figure 3C:
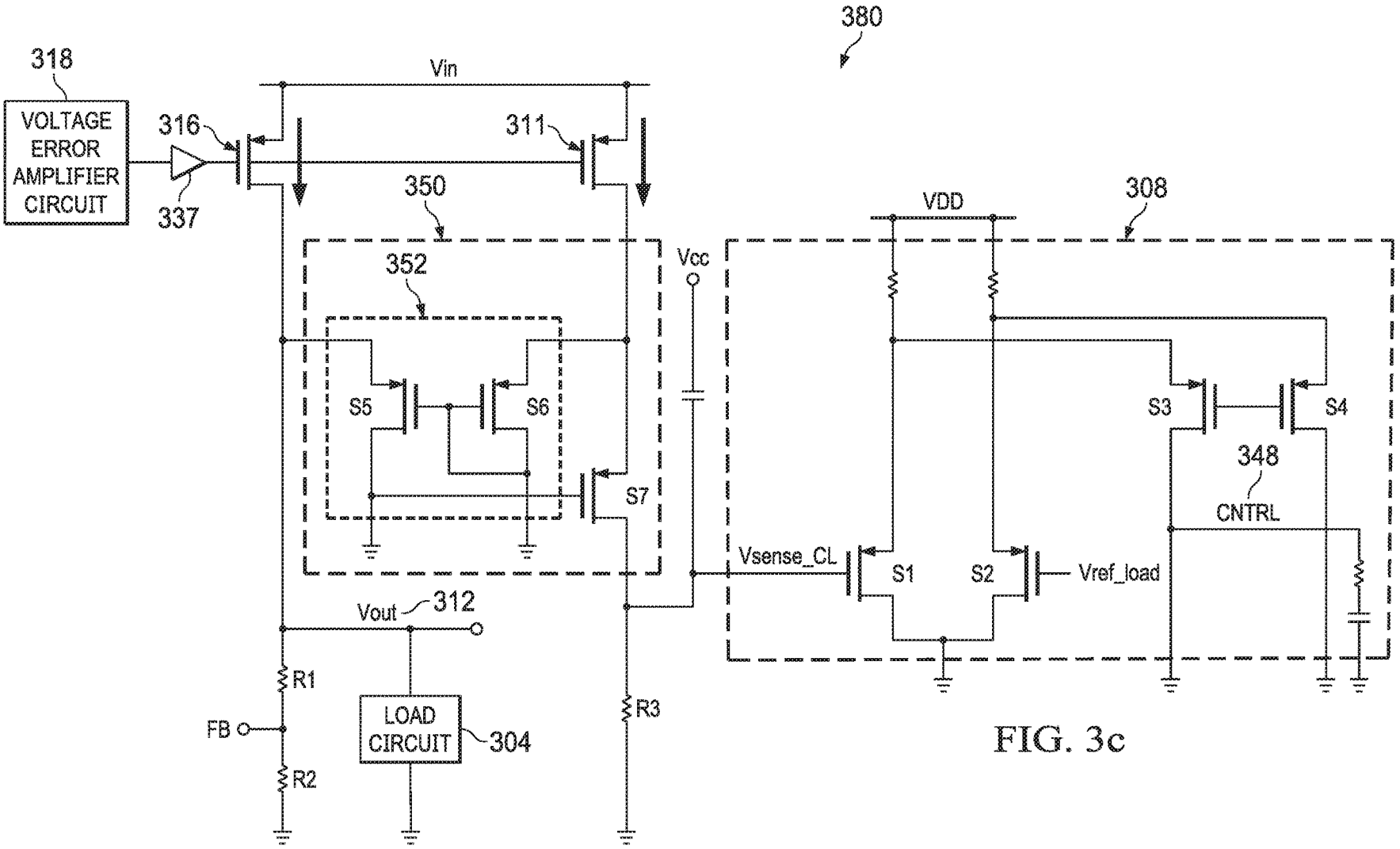
FIG. 3*c* illustrates an example implementation of a current limit amplifier circuit, according to one embodiment of the disclosure.

In some aspects, the current limit amplifier circuit 308 may be implemented as illustrated in FIG. 3*c*. Specifically, the current limit amplifier circuit 308 comprises a PMOS S1 adapted to receive the Vsense_CL and a PMOS S2 adapted to receive the Vref_load. Further, the current limit amplifier circuit 308 comprises a PMOS S3 coupled to S1 and a PMOS S4 coupled to S2. The drain terminal of the PMOS S3 is adapted to provide the CNTRL 348 based on a difference between the Vsense_CL and the Vref_load. However, other implementations of the current limit amplifier circuit 308 different from above are also contemplated to be within the scope of this disclosure. Referring back to FIG. 3*a*, in some aspects, the linear regulator system 300 may further comprise a voltage matching circuit (details of which are given in FIG. 3*c*) adapted to match a drain source voltage (Vds) of the pass element 316 and a drain source voltage (Vds) of the sense switch element 311. An example implementation of a voltage matching circuit 350 is illustrated in FIG. 3*b*. In particular, the voltage matching circuit 350 comprises a negative feedback amplifier 352 (a common gate negative feedback amplifier in this example) and a voltage matching switch element S7. The negative feedback amplifier 352 comprises a PMOS S5 and a PMOS S6, and is adapted to compare a voltage at the drain terminal of the pass element 316 and a voltage at the drain terminal of the sense switch element 311. Based on the comparison, the negative feedback amplifier 352 controls a gate terminal of the voltage matching switch element S7 so that the voltage at the drain terminal of the pass element 316 equals the voltage at the drain terminal of the sense switch element 311.

FIG. 3*b* is an example implementation of a linear regulator system 380, according to another aspect of the description. In some aspects, the linear regulator system 380 comprises one possible way of implementation of the linear regulator system 250 in FIG. 2*c*. The linear regulator system 380 comprises an input stage circuit 319 having a switch arrangement that differs from the input stage circuit 319 of the linear regulator system 300 in FIG. 3*a*. All the other features of the linear regular system 380 is similar to the linear regulator system 300 in FIG. 3*a* and is therefore, not repeated herein. Specifically, the voltage error amplifier circuit 318 in FIG. 3*b* includes an input stage circuit 319 comprising a first circuit leg 327 and a second circuit leg 328, both of which are coupled to a supply circuit 330. In this aspect, the supply circuit 330 comprises a negative supply source (e.g., ground). The input stage circuit 319 further includes a reference switch element 324 coupled to the first circuit leg 327 and a feedback switch element 326 coupled to the second circuit leg 328. In this aspect, the reference switch element 324 and the feedback switch element 326 comprise N-MOSFETs. Further, the reference switch element 324 and the feedback switch element 326 are symmetrically arranged with respect to one another. The reference switch element 324 is adapted to receive the output reference voltage Vout_ref 320 at a gate terminal 332 associated therewith. The feedback switch element 326 is adapted to receive the FB voltage 322 at a gate terminal 334 associated therewith.

The current limit circuit 306 includes a current limit switch element 338 and a symmetrical switch element 340. In this aspect, both the current limit switch element 338 and a symmetrical switch element 340 comprise N-MOSFETs. The current limit switch element 338 is coupled to the first circuit leg 327 in series with the reference switch element 324. In this aspect, a source terminal of the symmetrical switch element 338 is coupled to a drain terminal of the reference switch element 324 to form the series connection between the symmetrical switch element 338 and the reference switch element 324. The symmetrical switch element 340 is coupled to the second circuit leg 328 in series with the feedback switch element 326. In this aspect, a source terminal of the symmetrical switch element 340 is coupled to a drain terminal of the feedback switch element 326 to form the series connection between the symmetrical switch element 340 and the feedback switch element 326. Further, the current limit circuit 306 is coupled to a circuit path that couples output stage circuit 331 to the reference switch element 324 and the feedback switch element 326. Other implementations of the input stage circuit 319 that are different from above, where the current limit switch element 338 is coupled in series with one of the feedback switch element 326 and the reference switch element 324 are also contemplated to be within the scope of this disclosure.

Figure 4:
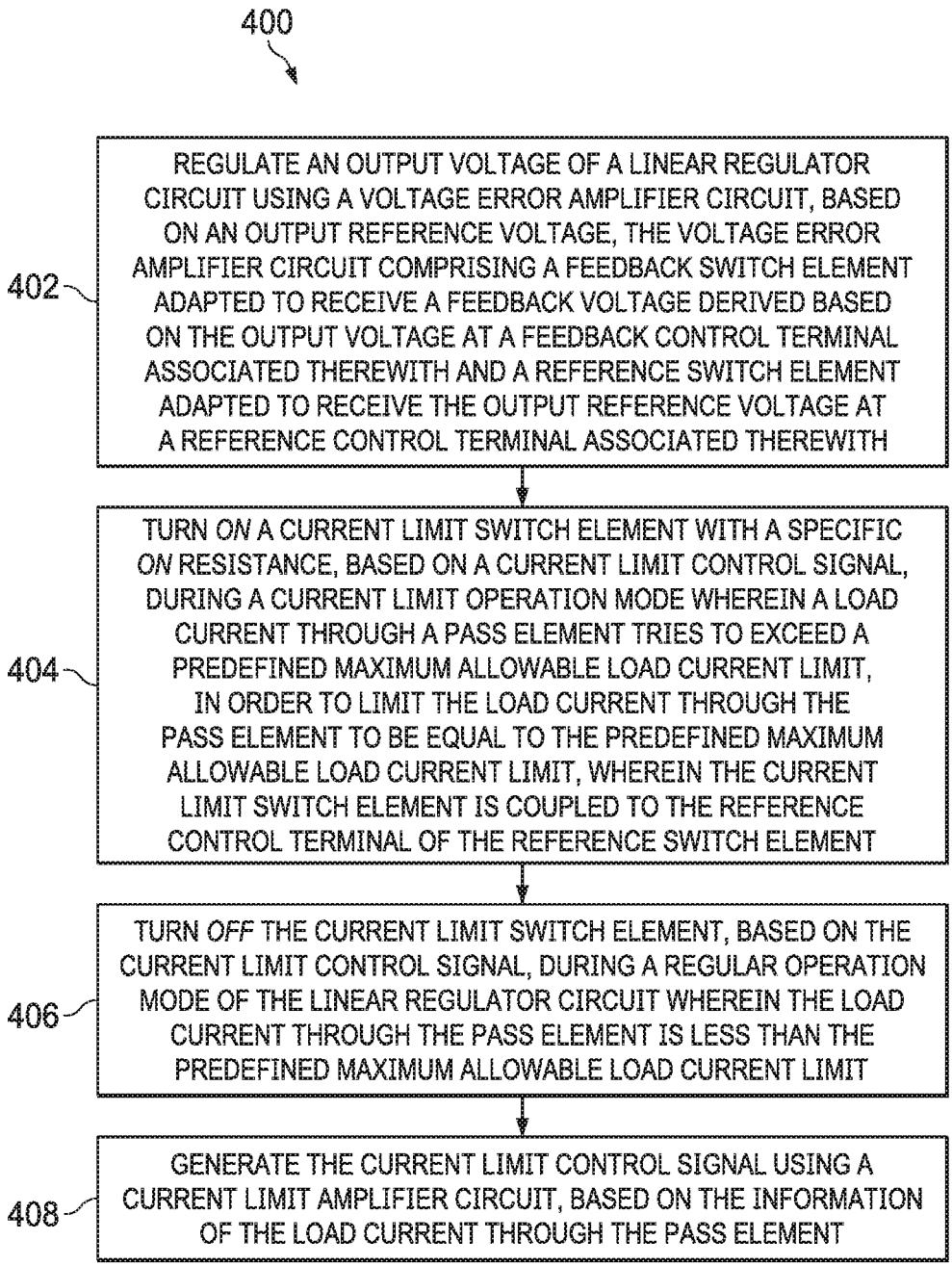
FIG. 4 is a flowchart of a method for current limit control in a linear regulator system, according to one aspect of the description.

FIG. 4 is a flowchart of an example method 400 for a linear regulator system, according to one aspect of the description. The method 400 may be implemented within the linear regulator system 100 in FIG. 1*a* and is therefore explained herein with reference to the linear regulator system 100 in FIG. 1*a*. At 402, an output voltage (e.g., the Vout 112) of a linear regulator core circuit (e.g., the linear regulator core circuit 102 in FIG. 1*a*) is regulated to at or near a regulated output voltage Vreg, using a voltage error amplifier circuit (e.g., the voltage error amplifier circuit 118), based on an output reference voltage (e.g., Vout_ref 120). The output voltage will remain at or near the regulated value as long as the current through the pass element is less than a predefined maximum allowable load current limit.

At 404, a current limit switch element (e.g., the current limit switch element 138) is turned ON in response to the assertion of a current limit control signal (e.g., the current limit control signal CNTRL 148)due to the current through the pass element increasing to or greater than the predefined maximum allowable load current limit. The current limit switch element is turned ON, in order to limit the current through the pass element so that it does not exceed the predefined maximum allowable load current limit. In some aspects, turning ON the current limit switch element modulates the output reference voltage of the voltage error amplifier circuit to a current limited reference voltage, thereby enabling to limit the load current to the predefined maximum allowable current limit. At 406, the current limit switch element is turned OFF, based on the current limit control signal, during the regular operation mode (such as when the current through the pass element is at an acceptable value). At 408, the current limit control signal is generated using a current limit amplifier circuit (e.g., the current limit amplifier circuit 108), based on information of the load current through the pass element. In some aspects, the current limit amplifier circuit is adapted to generate the current limit control signal, based on negative feedback.

Figure 5:
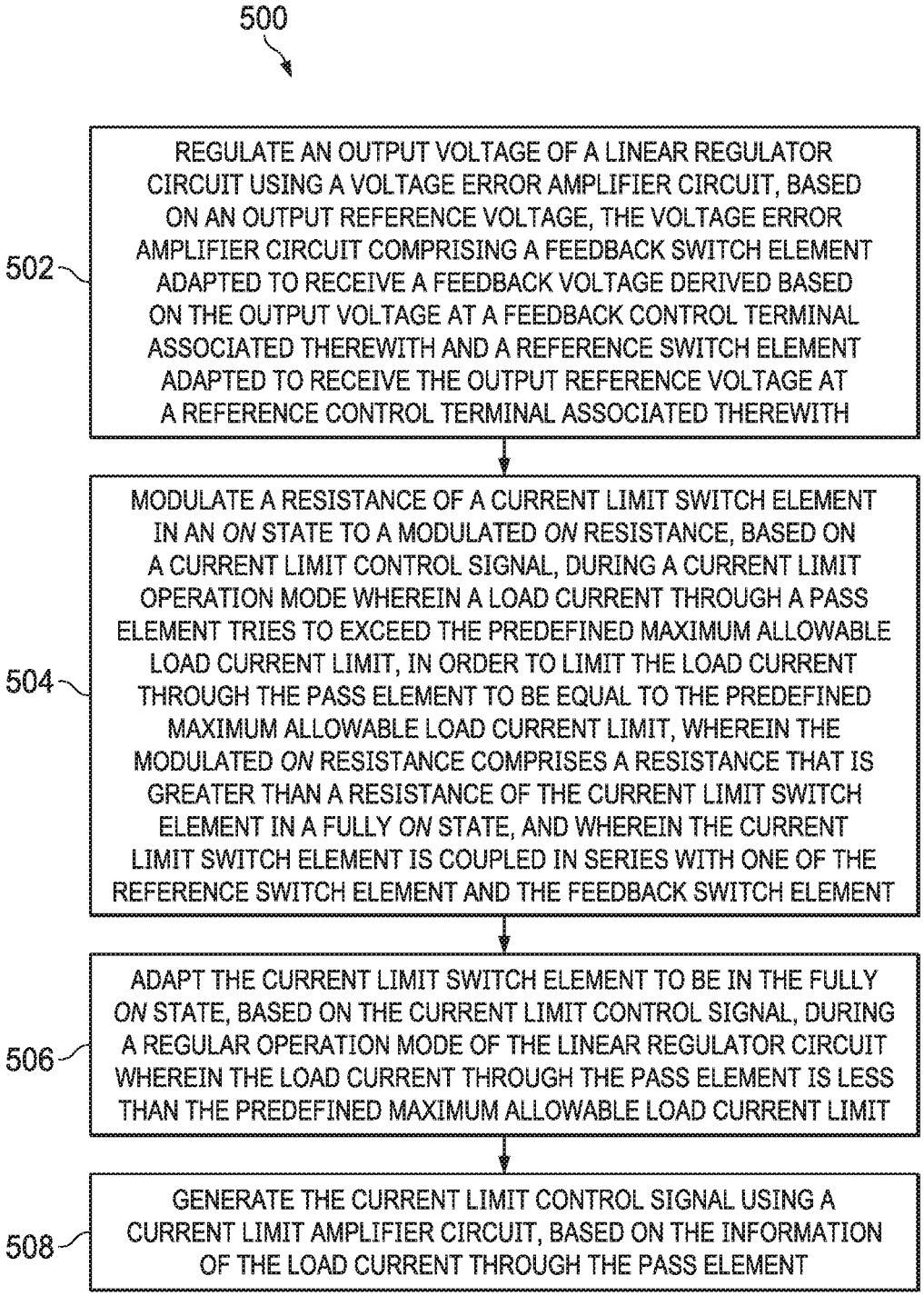
FIG. 5 is a flowchart of a method for current limit control in a linear regulator system, according to another aspect of the description.

FIG. 5 is a flowchart of an example method 500 for a linear regulator system, according to one aspect of the description. The method 500 may be implemented within the linear regulator system 200 in FIG. 2*a* and is therefore explained herein with reference to the linear regulator system 200 in FIG. 2*a*. However, method 500 is equally applicable to the linear regulator system 250 in FIG. 2*b*, the linear regulator system 300 in FIG. 3*a* and the linear regulator system 350 in FIG. 3*b*. At 502, an output voltage (e.g., the Vout 212) of a linear regulator core circuit (e.g., the linear regulator core circuit 202 in FIG. 2*a*) is regulated so that the output voltage is a regulated at or near output voltage Vreg, using a voltage error amplifier circuit (e.g., the voltage error amplifier circuit 218), based on an output reference voltage (e.g., Vout_ref 220). The output voltage will remain at or near the regulated value as long as the current through the pass element is less than a predefined maximum allowable load current limit.

At 504, a resistance of a current limit switch element (e.g., the current limit switch element 238) is modulated to a modulated ON resistance, in response to the assertion of a current limit control signal (e.g., the current limit control signal CNTRL 248) due to the current through the pass element increasing to or greater than the predefined maximum allowable load current limit. In some aspects, the modulated ON resistance comprises a resistance that is associated with an ON state of the current limit switch element and is greater than a resistance of the current limit switch element in a fully ON state. In some aspects, the current limit switch element is coupled in series with one of the reference switch element and the feedback switch element. In some aspects, the resistance of the current limit switch element is modulated to the modulated ON resistance, in order to limit the load current through the pass element to be equal to the predefined maximum allowable load current limit. In some aspects, modulating the resistance of the current limit switch element to the modulated ON resistance modulates the output reference voltage of the voltage error amplifier circuit to a current limited reference voltage, thereby enabling to limit the load current to the predefined maximum allowable current limit. At 506, the current limit switch element is adapted to be in the fully ON state, based on the current limit control signal, during the regular operation mode (such as when the current through the pass element is at an acceptable value). At 508, the current limit control signal is generated using a current limit amplifier circuit (e.g., the current limit amplifier circuit 208), based on information of the load current through the pass element. In some aspects, the current limit amplifier circuit is adapted to generate the current limit control signal, based on negative feedback.

The methods are illustrated and described above as a series of acts or events, but the illustrated ordering of such acts or events is not limiting. For example, some acts or events may occur in different orders and/or concurrently with other acts or events apart from those illustrated and/or described herein. Also, some illustrated acts or events are optional to implement one or more aspects or embodiments of this description. Further, one or more of the acts or events depicted herein may be performed in one or more separate acts and/or phases. In some embodiments, the methods described above may be implemented in a computer readable medium using instructions stored in a memory.

In this description, the term "couple" may cover connections, communications or signal paths that enable a functional relationship consistent with this description. Accordingly, if device A generates a signal to control device B to perform an action, then: (a) in a first example, device A is coupled directly to device B; or (b) in a second example, device A is coupled to device B through intervening component C if intervening component C does not substantially alter the functional relationship between device A and device B, so device B is controlled by device A via the control signal generated by device A. Modifications are possible in the described examples, and other implementations are possible, within the scope of the claims.

What is claimed is:

1. A linear regulator system, comprising:

a pass element having a control terminal, a first current terminal configured to couple to a supply source, and a second current terminal coupled to or forming a regulated output terminal that is configured to couple to a load;

a voltage error amplifier circuit having a first input coupled to a reference voltage, a second input coupled to a feedback node that provides a voltage indicative of a regulated output voltage at the regulated output terminal, and an output coupled to the control terminal of the pass element;

a current limit circuit having an output coupled to the voltage error amplifier circuit and operable to modulate the reference voltage to limit current through the pass element from exceeding a predefined maximum allowable load current limit; and wherein, the voltage error amplifier circuit is adapted to regulate an output voltage associated with the pass element to form the regulated output voltage, based on the reference voltage during a regular operation mode of the linear regulator system, wherein the current through the pass element is less than the predefined maximum allowable load current limit; and a current limit switch element is adapted to modulate the reference voltage of the voltage error amplifier circuit to form a current limited reference voltage during a current limit operation mode of the linear regulator system when the current through the pass element tries to exceed the predefined maximum allowable load current limit.

2. The linear regulator system of claim 1, further comprising a current limit amplifier circuit configured to generate a current limit control signal based on the current through the pass element and provide the current limit control signal to a current limit switch element.

3. The linear regulator system of claim 1, wherein the voltage error amplifier circuit comprises an input stage circuit comprising:

a reference switch element adapted to receive the reference voltage at a reference control terminal associated therewith; and a feedback switch element adapted to receive a feedback voltage from the feedback node at a feedback control terminal associated therewith.

4. The linear regulator system of claim 3, wherein a source/drain of the current limit switch element is coupled to the reference control terminal of the reference switch element.

5. The linear regulator system of claim 4, wherein the current limit switch element is adapted to be turned ON with a specific ON resistance, based on a current limit control signal during the current limit operation mode in order to modulate the reference voltage to form the current limited reference voltage.

6. The linear regulator system of claim 4, wherein the current limit switch element is adapted to be turned OFF based on a current limit control signal during the regular operation mode.

7. The linear regulator system of claim 4, wherein the current limit circuit further comprises an input filter circuit coupled to the current limit switch element, the input filter circuit comprising a resistive element and a capacitive element coupled in series to one another, and wherein the resistive element within the input filter circuit and the current limit switch element together form a voltage divider arrangement when the current limit switch element is turned ON to modulate the reference voltage.

8. The linear regulator system of claim 3, wherein the current limit circuit is comprised within the input stage circuit, and wherein the current limit switch element is coupled in series to one of the reference switch element and the feedback switch element.

9. The linear regulator system of claim 8, wherein a resistance of the current limit switch element is modulated to a modulated ON resistance, based on a current limit control signal during the current limit operation mode to modulate the reference voltage, wherein the modulated ON resistance of the current limit switch element is greater than a resistance of the current limit switch element in a fully ON state.

10. The linear regulator system of claim 9, wherein the current limit switch element is adapted to be in the fully ON state, based on the current limit control signal, during the regular operation mode.

11. The linear regulator system of claim 8, wherein a source/drain of the current limit switch element is coupled to a source/drain of the feedback switch element, to form the series connection between the current limit switch element and the feedback switch element.

12. The linear regulator system of claim 8, wherein a source/drain of the current limit switch element is coupled to a source/drain of the reference switch element, to form the series connection between the current limit switch element and the reference switch element.

13. A linear regulator system, comprising:

a pass element having a control terminal, a first current terminal configured to couple to a supply source, and a second current terminal coupled to or forming a regulated output terminal that is configured to couple to a load;

a voltage error amplifier circuit having a first input coupled to a reference voltage, a second input coupled to a feedback node that provides a voltage indicative of a regulated output voltage at the regulated output terminal, and an output coupled to the control terminal of the pass element, the voltage error amplifier circuit comprising an input stage circuit that comprises:

a feedback switch element adapted to receive a feedback voltage from the feedback node at a feedback control terminal associated therewith;

a reference switch element adapted to receive the reference voltage at a reference control terminal associated therewith; and a current limit circuit comprising a current limit switch element coupled in series to one of the reference switch element and the feedback switch element, wherein a resistance of the current limit switch element is adapted to be selectively modulated to a modulated ON resistance, based on a current limit control signal received at a current limit control terminal associated therewith to limit a current through the pass element from exceeding a predefined maximum allowable load current limit, wherein the modulated ON resistance comprises a resistance that is greater than a resistance of the current limit switch element in a fully ON state.

14. The linear regulator system of claim 13, wherein the resistance of the current limit switch element is modulated to the modulated ON resistance during a current limit operation mode when the current through the pass element tries to exceed the predefined maximum allowable load current limit.

15. The linear regulator system of claim 14, wherein the current limit switch element is adapted to be in the fully ON state, based on the current limit control signal during a regular operation mode of the linear regulator system when the current through the pass element is less than the predefined maximum allowable load current limit.

16. The linear regulator system of claim 15, wherein the current limit circuit further comprises a symmetrical switch element adapted to be in the fully ON state during the regular operation mode and the current limit operation mode, wherein the symmetrical switch element is coupled in series with the reference switch element when the current limit switch element is coupled in series with the feedback switch element, and wherein the symmetrical switch element is coupled in series with the feedback switch element when the current limit switch element is coupled series with the reference switch element.

17. The linear regulator system of claim 15, wherein the voltage error amplifier circuit is adapted to regulate the output voltage to form the regulated output voltage based on the reference voltage during the regular operation mode.

18. The linear regulator system of claim 15, further comprising a current limit amplifier circuit configured to generate the current limit control signal based on the current through the pass element and provide the current limit control signal to the current limit switch element.

19. A linear regulator system, comprising:

a pass element having a control terminal, a first current terminal configured to couple to a supply source, and a second current terminal coupled to or forming a regulated output terminal that is configured to couple to a load;

a voltage error amplifier circuit having a first input coupled to a reference voltage, a second input coupled to a feedback node that provides a voltage indicative of a regulated output voltage at the regulated output terminal, and an output coupled to the control terminal of the pass element, the voltage error amplifier circuit comprising an input stage circuit that comprises:

a feedback switch element adapted to receive a feedback voltage from the feedback node at a feedback control terminal associated therewith;

a reference switch element adapted to receive the reference voltage at a reference control terminal associated therewith; and a current limit circuit comprising a current limit switch element coupled to the reference control terminal of the reference switch element and adapted to be selectively turned ON with a specific ON resistance based on a current limit control signal received at a current limit control terminal associated therewith to limit a load current through the pass element from exceeding a predefined maximum allowable load current limit.

20. The linear regulator system of claim 19, wherein a source/drain of the current limit switch element is coupled to the reference control terminal of the reference switch element.

21. The linear regulator system of claim 20, wherein the current limit switch element is turned ON with the specific ON resistance based on the current limit control signal during a current limit operation mode when the current through the pass element tries to exceed the predefined maximum allowable load current limit.

22. The linear regulator system of claim 20, wherein the current limit switch element is adapted to be turned OFF based on the current limit signal during a regular operation mode of the linear regulator system when the current through the pass element is less than the predefined maximum allowable load current limit.

23. The linear regulator system of claim 20, wherein the current limit circuit further comprises an input filter circuit coupled to the current limit switch element, the input filter circuit comprising a resistive element and a capacitive element coupled in series to one another, and wherein the resistive element within the input filter circuit and the current limit switch element together form a voltage divider arrangement, when the current limit switch element is turned ON in order to modulate the reference voltage.

24. The linear regulator system of claim 23, wherein the voltage error amplifier circuit is adapted to regulate the output voltage to form the regulated output voltage, based on the reference voltage during the regular operation mode.

25. The linear regulator system of claim 20, further comprising a current limit amplifier circuit configured to generate the current limit control signal based on the current through the pass element and provide the current limit control signal to the current limit switch element.

* * * * *